US009184504B2

(12) United States Patent
Tatarnikov et al.

(10) Patent No.: US 9,184,504 B2
(45) Date of Patent: Nov. 10, 2015

(54) COMPACT DUAL-FREQUENCY PATCH ANTENNA

(75) Inventors: Dmitry Tatarnikov, Moscow (RU); Anton Stepanenko, Dedovsk (RU); Andrey Astakhov, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 560 days.

(21) Appl. No.: 13/448,450

(22) Filed: Apr. 17, 2012

(65) Prior Publication Data

US 2012/0268347 A1 Oct. 25, 2012

Related U.S. Application Data

(60) Provisional application No. 61/478,632, filed on Apr. 25, 2011.

(51) Int. Cl.

| | |
|---|---|
| ***H01Q 1/38*** | (2006.01) |
| ***H01Q 9/04*** | (2006.01) |
| ***H01Q 13/10*** | (2006.01) |
| ***H01Q 5/40*** | (2015.01) |

(52) U.S. Cl.

CPC ..... *H01Q 9/0464* (2013.01); *H01Q 5/40* (2015.01); *H01Q 9/0407* (2013.01); *H01Q 13/106* (2013.01)

(58) Field of Classification Search

USPC ..... 343/700 MS, 893, 789, 702

See application file for complete search history.

(56) References Cited

U.S. PATENT DOCUMENTS

| | | | | | |
|---|---|---|---|---|---|
| 3,736,534 | A * | 5/1973 | Chaffee | ..... | 333/161 |
| 5,548,297 | A * | 8/1996 | Arai | ..... | 343/700 MS |
| 5,995,058 | A * | 11/1999 | Legay et al. | ..... | 343/789 |
| 6,593,895 | B2 * | 7/2003 | Nesic et al. | ..... | 343/795 |
| 6,597,316 | B2 * | 7/2003 | Rao et al. | ..... | 343/700 MS |
| 2002/0008663 | A1 * | 1/2002 | Suguro et al. | ..... | 343/700 MS |

FOREIGN PATENT DOCUMENTS

| | | | | | |
|---|---|---|---|---|---|
| EP | 0 860 894 | | 8/1998 | | |
| EP | 0860894 | * | 8/1998 | ..... | H01Q 5/00 |
| WO | WO 03/026069 | | 3/2003 | | |

OTHER PUBLICATIONS

PCT International Search Report, dated Aug. 2, 2012, corresponding to PCT Application No. PCT/IB2012/000768 filed Apr. 18, 2012 (4 pages).

Written Opinion of the International Searching Authority, dated Aug. 2, 2012, corresponding to PCT Application No. PCT/IB2012/000768 filed on Apr. 18, 2012 (8 pages).

* cited by examiner

*Primary Examiner* — Hoang V Nguyen
*Assistant Examiner* — Hai Tran
(74) *Attorney, Agent, or Firm* — Chiesa Shahinian & Giantomasi PC

(57) ABSTRACT

A dual-frequency patch antenna includes a ground plane, an inside radiator, and an outside radiator. The inside radiator is configured as a region with a periphery, along which is a series of first protrusions separated by first grooves. The outside radiator is configured as a ring with an outer periphery and an inner periphery, along which is a series of second protrusions separated by second grooves. A set of conducting elements electrically connect the series of second protrusions with the ground plane. The inside radiator and the outside radiator can be fabricated on a dielectric substrate separated from the ground plane by a dielectric solid or air. The inside radiator and the outside radiator can be disposed on the same surface or on different surfaces of the dielectric substrate, with specific geometries of the first protrusions and first grooves relative to the second protrusions and second grooves.

40 Claims, 24 Drawing Sheets

VIEW A

VIEW A

VIEW X-X'

VIEW A

VIEW X-X'

VIEW X-X'

VIEW P

VIEW X-X'

VIEW P

VIEW X-X'

VIEW P

VIEW C

VIEW D

VIEW X-X'

VIEW X-X'

VIEW C

VIEW D

COMPACT DUAL-FREQUENCY PATCH ANTENNA

This application claims the benefit of U.S. Provisional Application No. 61/478,632 filed Apr. 25, 2011, which is incorporated herein by reference.

BACKGROUND OF THE INVENTION

The present invention relates to antennas, and in particular, to dual-frequency patch antennas.

Patch antennas are well suited for navigation receivers in global navigation satellite systems (GNSSs). These antennas have the desirable features of compact size, light weight, and wide bandwidth. Wide bandwidth is of particular importance for navigation receivers that receive and process signals from more than one frequency band. Within a single GNSS, such as the U.S. Global Positioning System (GPS), processing signals from more than one frequency band allows certain errors to be reduced and the accuracy of coordinates to be increased. For GPS, the two primary frequency bands are the $L_1$ band and the $L_2$ band. For the $L_1$ band, the mid-band frequency is approximately 1575 MHz, corresponding to a free-space (vacuum) wavelength of approximately 19 cm. For the $L_2$ band, the mid-band frequency is approximately 1227 MHz, corresponding to a free-space wavelength of approximately 24.4 cm. In addition to GPS, the Russian GLONASS GNSS is available. Other GNSSs such as the European GALILEO system are planned. Multi-system navigation receivers (navigation receivers that can process signals from more than one GNSS) can provide higher reliability due to system redundancy and better coverage due to a line-of sight to more satellites. Multi-system navigation receivers process signals from more than one frequency band.

For GNSS applications, a dual-frequency patch antenna with compact size, light weight, and wide operational bandwidth is desirable. Other desirable properties of patch antennas for GNSS applications include a broad directional pattern in the forward hemisphere to increase the number of satellites in view, and a weak directional pattern in the backward hemisphere to reduce multipath reception.

BRIEF SUMMARY OF THE INVENTION

A dual-frequency patch antenna includes a ground plane, a first radiator, and a second radiator. The first radiator is configured as a first region with a first periphery. Along the first periphery is disposed a series of first protrusions separated by a series of first grooves. The second radiator is configured as a second region with a second periphery and a third periphery; the second periphery is disposed within the third periphery. Along the second periphery is disposed a series of second protrusions separated by a series of second grooves. The first radiator and the second radiator are disposed on a dielectric substrate that has a first surface facing away from the ground plane and a second surface facing towards the ground plane. The dielectric substrate is separated from the ground plane by a dielectric medium that can be a dielectric solid or air. A set of conducting elements electrically connect locations within the second protrusions, or locations within the second region adjacent to the second protrusions, with the ground plane.

In a first embodiment, the first radiator and the second radiator are both disposed on the first surface of the dielectric substrate. The first radiator is disposed with respect to the second radiator such that the first periphery is disposed within the second periphery, the first protrusions are disposed partially within the second grooves, and the second protrusions are disposed partially within the first grooves. There is no contact between the first protrusions and the second protrusions, between the first protrusions and the second periphery, and between the second protrusions and the first periphery.

In a second embodiment, the first radiator is disposed on the first surface of the dielectric substrate and the second radiator is disposed on the second surface of the dielectric substrate. The first radiator is disposed with respect to the second radiator such that the projection, onto the second surface, of the first periphery is disposed within the second periphery; the projections, onto the second surface, of the first protrusions are disposed partially within the second grooves; and the second protrusions are disposed partially within the projections, onto the second surface, of the first grooves. The projections, onto the second surface, of the first protrusions can further be disposed partially within the second region.

In a third embodiment, the first radiator is disposed on the second surface of the dielectric substrate, and the second radiator is disposed on the first surface of the dielectric substrate. The first radiator is disposed with respect to the second radiator such that the projection, onto the first surface, of the first periphery is disposed within the second periphery; the projections, onto the first surface, of the first protrusions are disposed partially within the second grooves; and the second protrusions are disposed partially within the projections, onto the first surface, of the first grooves. The projections, onto the first surface, of the first protrusions can further be disposed partially within the second region.

In a fourth embodiment, the first region of the first radiator is disposed on the second surface, and the series of first protrusions separated by the series of first grooves are disposed on the first surface such that the series of first protrusions and the series of first grooves are disposed along the projection, onto the first surface, of the first periphery. A set of conducting elements electrically connect the series of first protrusions with the first region along the first periphery. The second radiator is disposed on the second surface of the dielectric substrate. The first radiator is disposed with respect to the second radiator such the first periphery is disposed within the second periphery; the projection, onto the second surface, of the first protrusions are disposed partially within the second grooves; and the second protrusions are disposed partially within the projections, onto the second surface, of the first grooves. The projections, onto the second surface, of the first protrusions can further be disposed partially within the second region.

Various embodiments of the dual-frequency patch antenna can include a set of capacitive elements disposed along the third periphery of the second radiator; a set of capacitive elements disposed along a path on the ground plane; or a set of first capacitive elements disposed along the third periphery of the second radiator and a set of second capacitive elements disposed along a path on the ground plane.

Various embodiments of the dual-frequency patch antenna can include an excitation system configured to excite circularly-polarized electromagnetic radiation or linearly-polarized radiation in the first radiator; an excitation system configured to excite circularly-polarized electromagnetic radiation or linearly-polarized radiation in the second radiator; or a first excitation system configured to excite first circularly-polarized electromagnetic radiation in the first radiator and a second excitation system configured to excite second circularly-polarized electromagnetic radiation in the second radiator.

These and other advantages of the invention will be apparent to those of ordinary skill in the art by reference to the following detailed description and the accompanying drawings.

DETAILED DESCRIPTION

Although antennas in global navigation satellite systems (GNSS) receivers operate in the receive mode, standard antenna engineering practice characterizes antennas in the transmit mode. According to the well-known antenna reciprocity theorem, however, antenna characteristics in the receive mode correspond to antenna characteristics in the transmit mode.

Figure 1A:
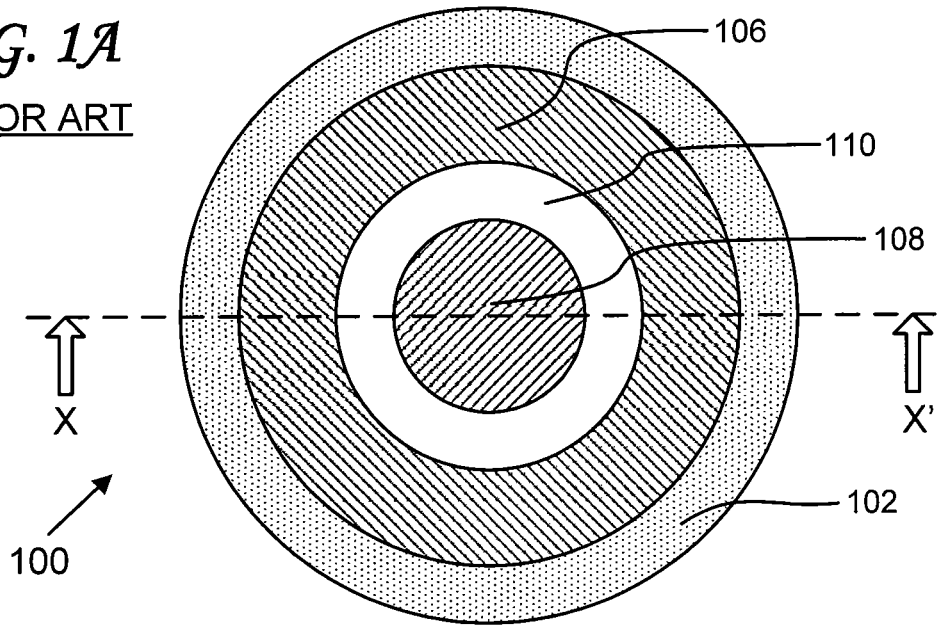
FIG. 1A PRIOR ART
FIG. 1A and FIG. 1B show a prior-art dual-band patch antenna.

A prior-art dual-system, dual-frequency patch antenna as described in U.S. Pat. No. 5,548,297 ("Arai") is shown in FIG. 1A (plan view, View A) and FIG. 1B (cross-sectional view, View X-X'). The patch antenna is designed to operate in the 1.5 GHz band for the Global Positioning System (GPS) and in the 2.5 GHz band for the Road Traffic Information Communications System [also known as the Vehicle Information and Communication System (VICS)]. VICS is not satellite based; it uses ground-level radiofrequency (RF) transmissions.

The patch antenna 100 is fabricated on a circular dielectric substrate 102. A conducting ground plane 104 is formed on one face of the substrate, and two radiators are formed on the opposite face. A radiator 106 is configured as a ring (annulus) near the outside of the substrate 102. A radiator 108 is configured as a disc at the center of the substrate 102. The two radiators are separated by a gap 110.

Figure 1B:
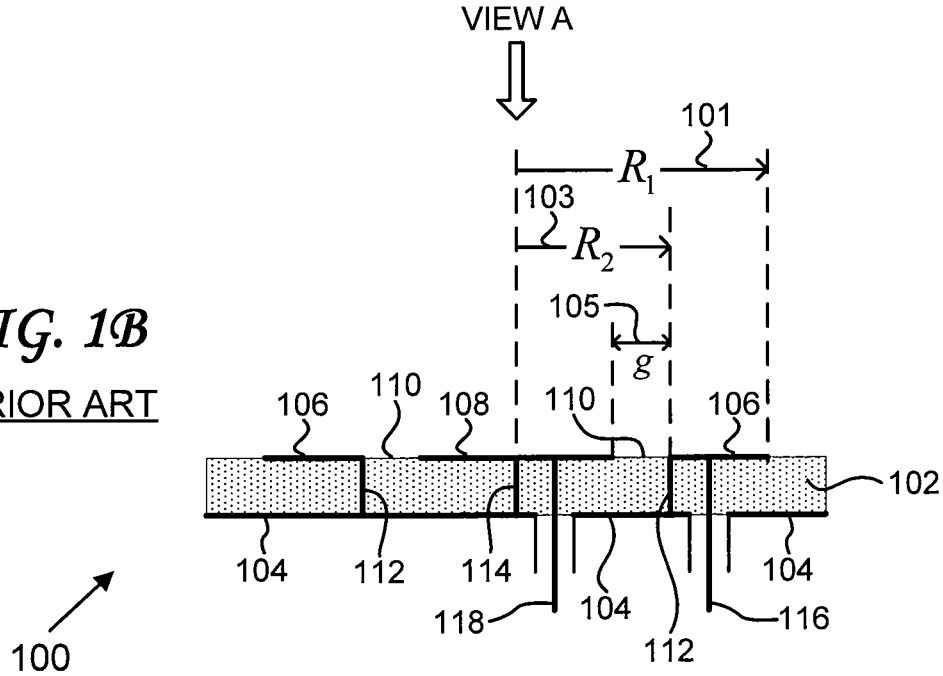
FIG. 1B PRIOR ART

The ring-shaped radiator 106 is shorted (bridged) to the ground plane 104 at the inner periphery by connector 112; the disc-shaped radiator 108 is shorted to the ground plane 104 at the center by connector 114. Each radiator, together with the ground plane, forms a resonator; therefore, this design forms a two-resonator radiating system. Electromagnetic power is supplied by a separate coaxial cable to each resonator; each coaxial cable includes an outside shield (ground) and a center conductor. As shown in FIG. 1B, the center conductor 116 feeds the ring-shaped radiator 106, and the center conductor 118 feeds the disc-shaped radiator 108.

Each resonator has a set of resonance frequencies. Operating antenna frequencies are determined by the selection of resonance oscillations. The $TM_{11}$ mode (E-waves) is used as the operating oscillation for the ring-shaped radiator 106, and the $TM_{01}$ mode is used as the operating oscillation for the disc-shaped radiator 108. These choices yield two types of directional pattern (DP). The ring-shaped radiator 106 operates in a circularly-polarized mode with a maximum DP at the zenith to receive GPS signals. The disc-shaped radiator 108 operates in a linearly-polarized mode with a maximum DP at the horizon to receive VICS signals.

For a dual-frequency, two-channel ($L_1$-$L_2$) GPS antenna according to the above design, the $TM_{11}$ mode should also be used as the operating oscillation of the disc-shaped radiator 108. This design, however, would require a larger antenna. In addition, for the ring-shaped radiator 106, the DP would be narrowed, and the frequency bandwidth of resonance oscillation would also be narrowed.

To expand the DP of the ring-shaped radiator 106, the outside radius $R_1$ 101 should be decreased. To keep the same operational frequency, the dielectric permittivity of the dielectric substrate 102 needs to be increased; increasing the dielectric permittivity, however, narrows the operational bandwidth of the resonance oscillation of the ring-shaped radiator 106 even further. To expand the operational bandwidth, the inside radius $R_2$ 103 should be reduced. Reducing the inside radius, however, reduces the width g 105 of the gap between the ring-shaped radiator 106 and the disc-shaped radiator 108. Reduction of the gap width narrows the operational bandwidth of the resonance oscillation of the disc-shaped radiator 108. If the radius of the disc-shaped radiator 108 is decreased to keep the gap width g the same, the operational bandwidth is narrowed, and the DP level in the backward hemisphere is increased (raising the multipath level).

Figure 2A:
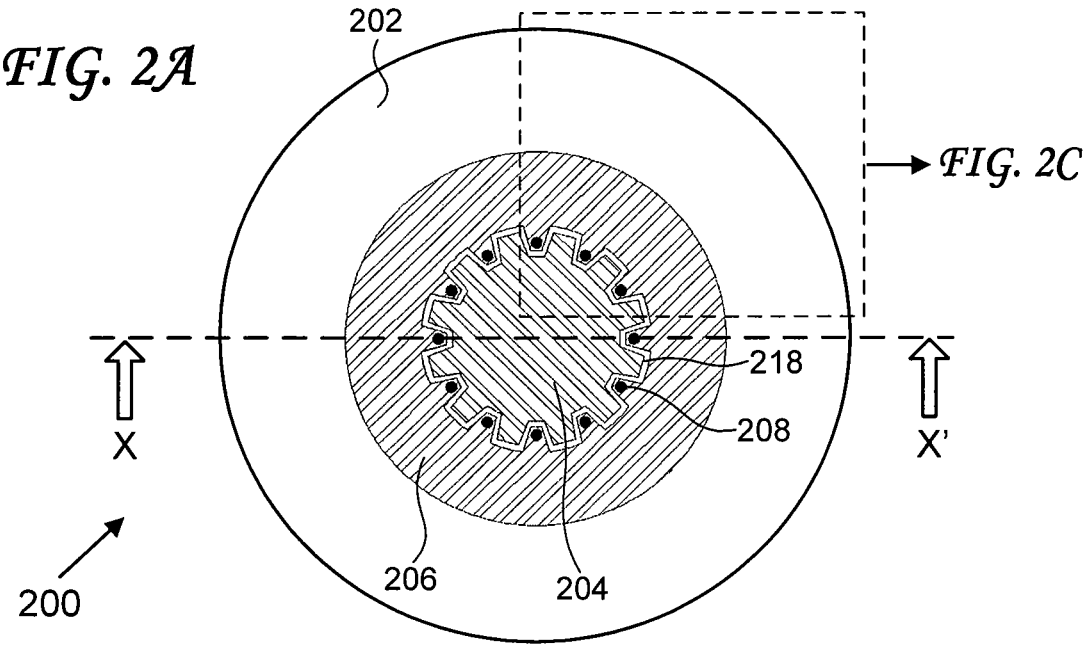
FIG. 2A-FIG. 2J show a dual-band patch antenna according to a first embodiment.
Figure 2B:
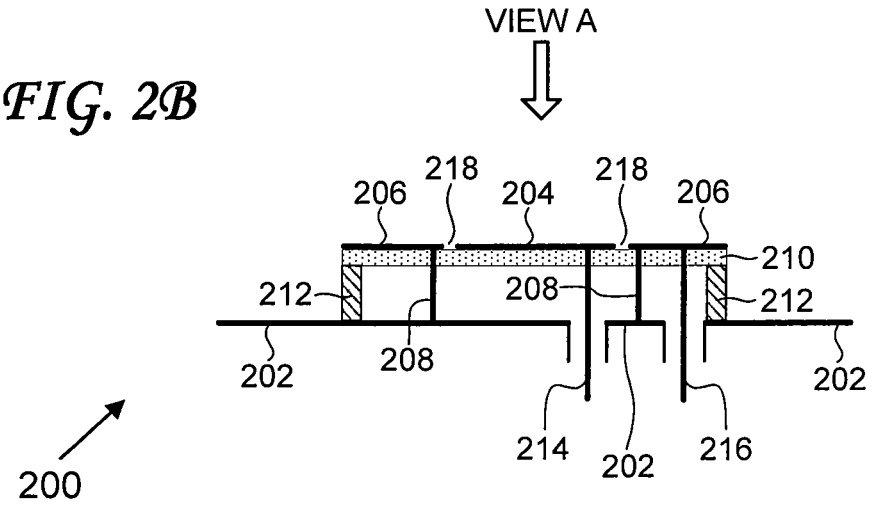

FIG. 2A (plan view, View A) and FIG. 2B (cross-sectional view, View X-X') show a dual-frequency patch antenna 200, according to a first embodiment of the invention. The dual-frequency patch antenna 200 includes a substantially planar conducting ground plane 202, an inside radiator 204, an outside radiator 206, and a set of conducting elements 208 that electrically connects the outside radiator 206 with the ground plane 202. The inside radiator 204 and the outside radiator 206 are metal patches. Each conducting element in the set of conducting elements 208 can be configured as a thin metal plate or pin of a user-specified shape. Each conducting element in the set of conducting elements 208 is substantially orthogonal to the ground plane 202 and substantially orthogonal to the outside radiator 206.

Since the set of conducting elements 208 electrically connects the outside radiator 206 with the ground plane 202 along the inner periphery of the outside radiator 206, the electric field excited by the outside radiator 206 in the region of the set of conducting elements 208 is not intense. There is consequently good isolation between the outside radiator 206 and the inside radiator 204.

The inside radiator 204 and the ground plane 202 form a first resonance cavity. The radiating slot of the first resonance cavity is formed by the gap 218 (see magnified view in FIG. 2C) between the inside radiator 204 and the outside radiator 206. A set of conducting elements is not configured to connect points along the outer periphery of the inside radiator 204 because the first resonance cavity would be completely shorted and would not radiate.

The outside radiator 206 and the ground plane 202 form a second resonance cavity. The radiating slot of the second resonance cavity is formed by the outer periphery of the outside radiator 206 and the ground plane 202 in the region of the dielectric supports 212 (see below).

In an embodiment, the inside radiator 204 and the outside radiator 206 are fabricated as conducting films, such as metal films, on a substantially planar dielectric substrate 210. The dielectric substrate 204 is substantially parallel to the ground plane 202. The inside radiator 204 and the outside radiator 206 can also be fabricated from sheet metal. The dielectric substrate 210, for example, can be a printed circuit board (PCB). In the embodiment shown in FIG. 2B, the dielectric substrate 210 is supported above the ground plane 202 by dielectric supports 212 near the periphery of the dielectric substrate 210; the interior volume between the dielectric substrate 210 and the ground plane 202 is filled with air. In another embodiment, the entire volume between the dielectric substrate 210 and the ground plane 202 is filled with a solid dielectric. The solid dielectric can be a different structure (and different material) from the dielectric substrate 210, or the dielectric substrate 210 can fill the entire volume.

Figure 2C:
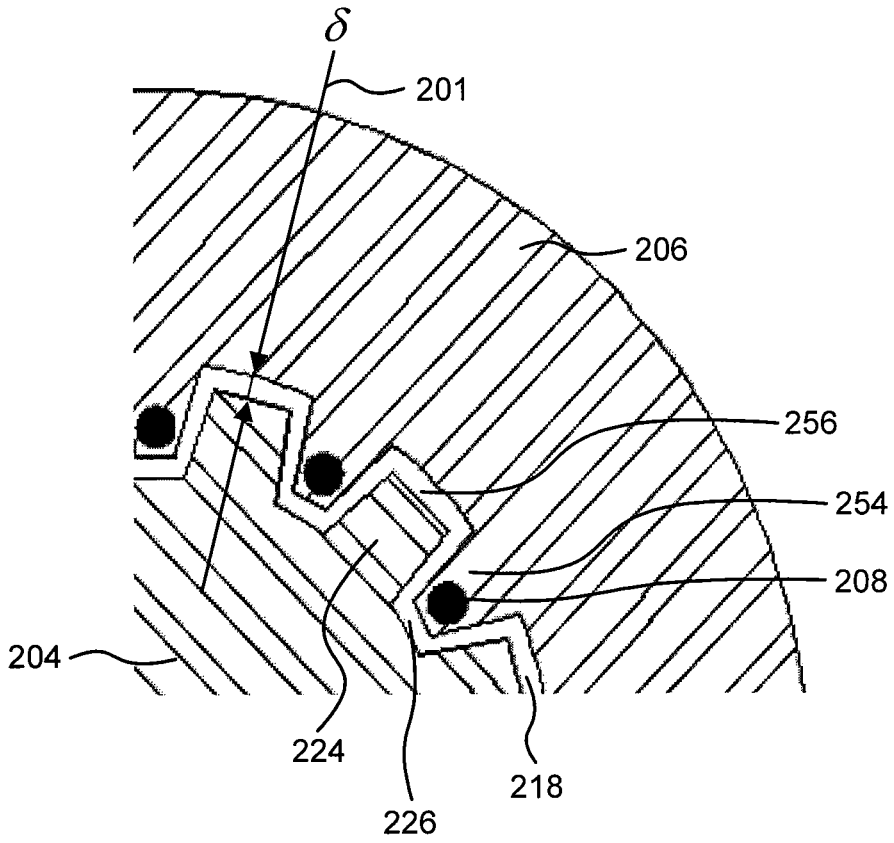
Figure 2D:
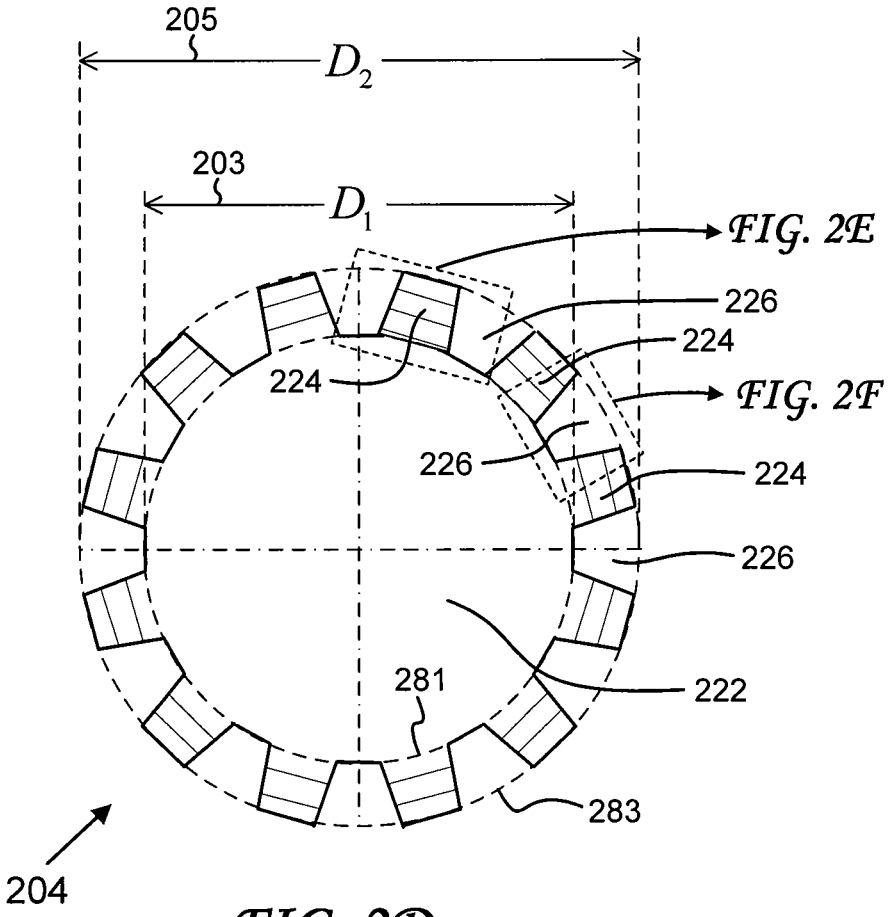

FIG. 2D shows a detailed view of the inside radiator 204, characterized by a reference circle 281 (with a diameter $D_1$ 203) and by a reference circle 283 (with a diameter $D_2$ 205). It includes a central region 222 shaped as a circular disc within the reference circle 281. Along the periphery of the central region 222 is a series of protrusions 224 separated by a series of grooves 226. The number, shape, size, area, and spacing of the protrusions 224 and grooves 226 are user-defined. For a patch antenna operating over a frequency band from about 1165 to about 1605 MHz, typical values of $D_1$ are 30-40 mm, and typical values of $D_2$ are about 40-60 mm. Values listed below for other parameters also apply for the same frequency band.

Figure 2E:
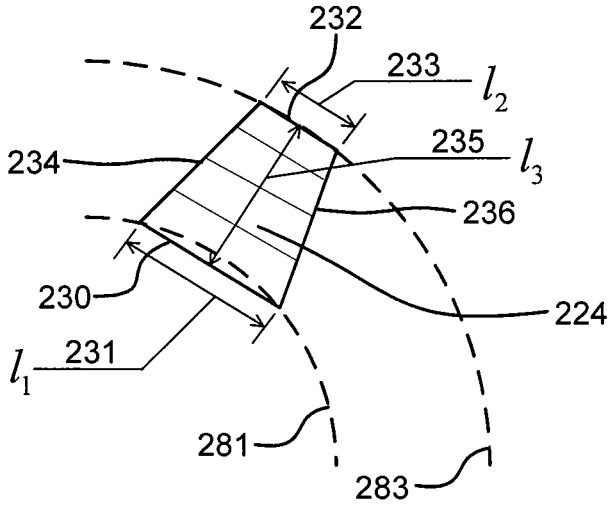

FIG. 2E shows a magnified view of a protrusion 224. In this example, the protrusion is characterized as an isosceles trapezoid, with parallel side 230, parallel side 232, oblique side 234, and oblique side 236. The length of the parallel side 230 (closest to the central region 222) is $l_1$ 231; the length of the parallel side 232 is $l_2$ 233 (with $l_1>l_2$). Here, $l_1$ and $l_2$ refer to chord lengths. The altitude (height) of the trapezoid is $l_3$ 235. Typical values of $l_1$ are about 2-4 mm; typical values of $l_2$ are about 4-6 mm; and typical values of $l_3$ are about 6-12 mm.

Figure 2F:
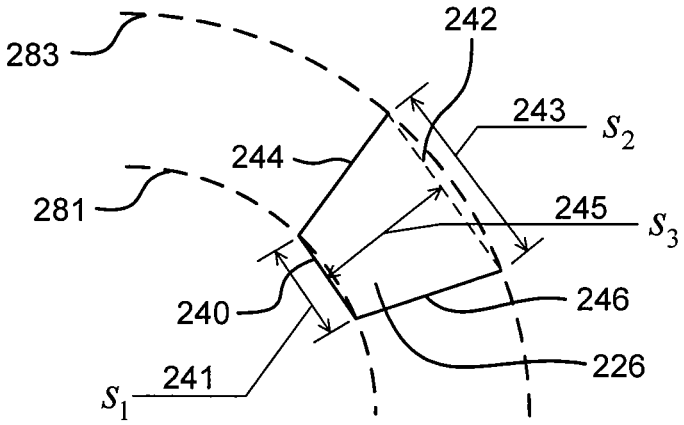

FIG. 2F shows a magnified view of a groove 226. In this example, the groove is characterized as an isosceles trapezoid, with parallel side 240, parallel side 242, oblique side 244, and oblique side 246. The length of the parallel side 240 (closest to the central region 222) is $s_1$ 241; the length of the parallel side 242 is $s_2$ 243 (with $s_1<s_2$). The altitude (height) of the trapezoid is $s_3$ 245. Here, $s_1$ and $s_2$ refer to chord lengths. Typical values of $s_1$ are about 4-6 mm; typical values of $s_2$ are about 6-8 mm; and typical values of $s_3$ are about 8-12 mm.

Figure 2G:
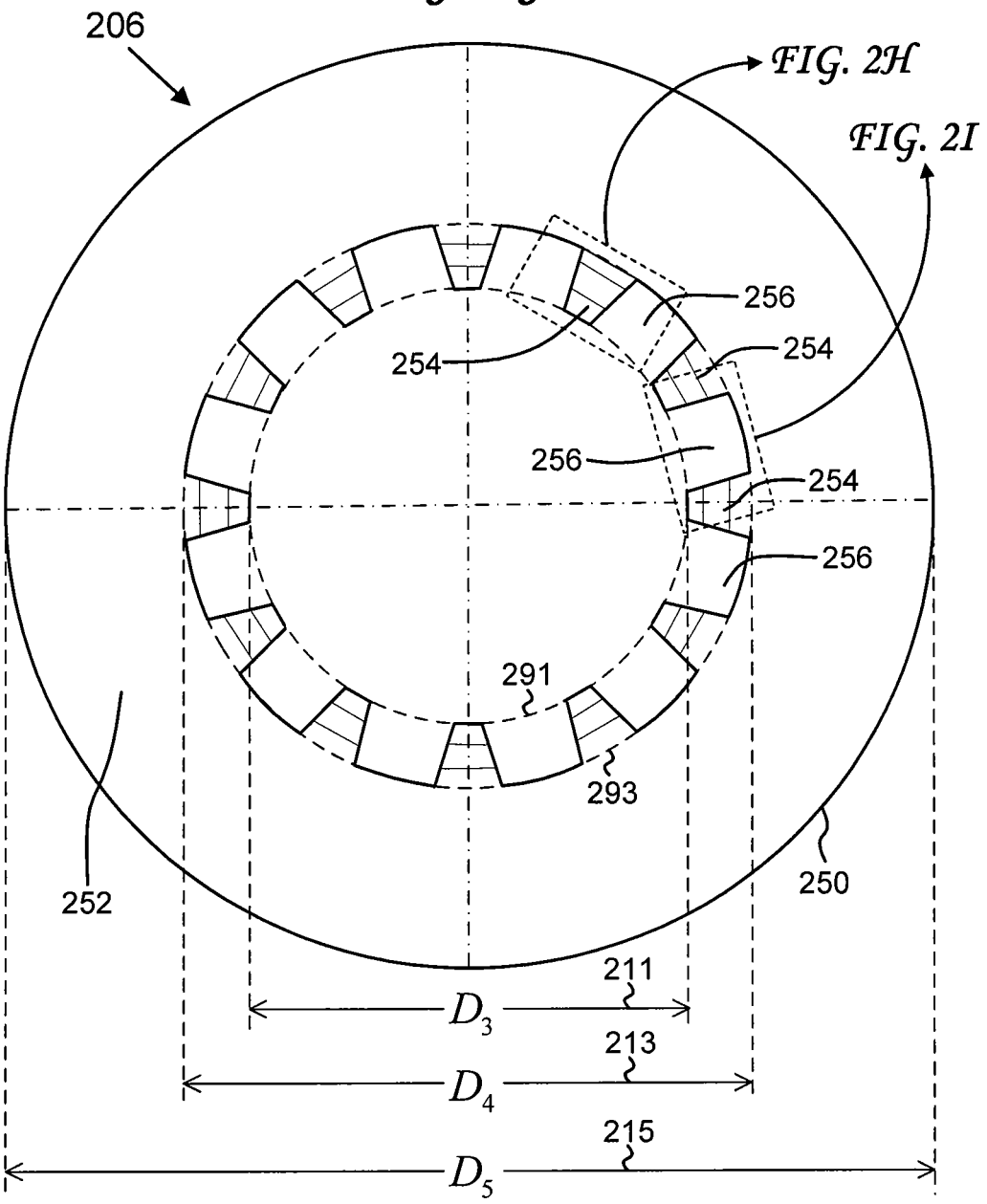

FIG. 2G shows a detailed view of the outside radiator 206, characterized by a reference circle 291 (with a diameter $D_3$ 211), a reference circle 293 (with a diameter $D_4$ 213), and a reference circle 250 (with a diameter $D_5$ 215). It includes an annular region 252 bounded by the reference circle 293 and the reference circle 250. Along the reference circle 293 is a series of protrusions 254 separated by a series of grooves 256. The number, shape, size, area, and spacing of the protrusions 254 and grooves 256 are user-defined. Typical values of $D_3$ are about 30-40 mm; typical values of $D_4$ are about 40-60 mm; and typical values of $D_5$ are about 70-90 mm.

Figure 2H:
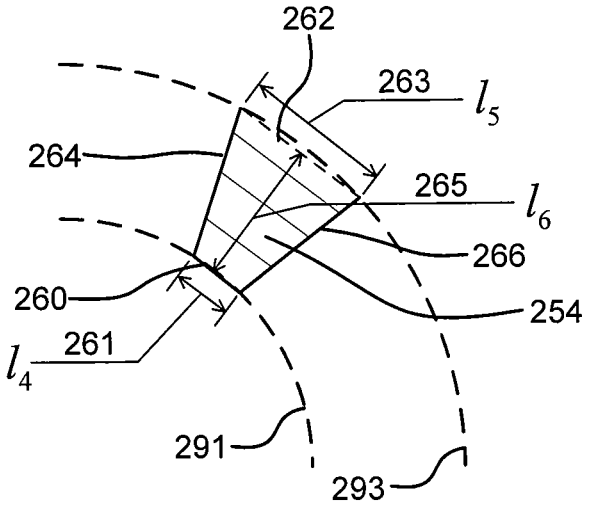

FIG. 2H shows a magnified view of a protrusion 254. In this example, the protrusion is characterized as an isosceles trapezoid, with parallel side 260, parallel side 262, oblique side 264, and oblique side 266. The length of the parallel side 260 (along the reference circle 291) is $l_4$ 261; the length of the parallel side 262 is $l_5$ 263 (with $l_5>l_4$). Here, $l_4$ and $l_5$ refer to chord lengths. The altitude (height) of the trapezoid is $l_6$ 265. Typical values of $l_4$ are about 2-4 mm; typical values of $l_5$ are about 4-6 mm; and typical values of $l_6$ are about 6-10 mm.

Figure 2I:
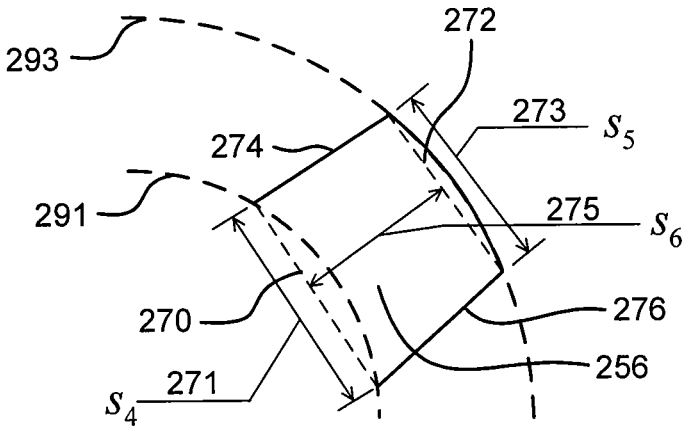

FIG. 2I shows a magnified view of a groove 256. In this example, the groove is characterized as an isosceles trapezoid, with parallel side 270, parallel side 272, oblique side 274, and oblique side 276. The length of the parallel side 270 (along the reference circle 291) is $s_4$ 271; the length of the parallel side 272 is $s_5$ 273 (with $s_4>s_5$). The altitude (height) of the trapezoid is $s_6$ 275. Here, $s_4$ and $s_5$ refer to chord lengths. Typical values of $s_4$ are about 4-6 mm; typical values of $s_5$ are about 6-8 mm; and typical values of $s_6$ are about 8-12 mm.

As discussed above, the protrusions and grooves can have other user-specified shapes; for example, they can be rectangular or triangular. The sides can be straight line segments or curvilinear segments. For example, side 230 and side 232 (FIG. 2E), side 240 and side 242 (FIG. 2F), side 260 and side 262 (FIG. 2H), and side 270 and side 272 (FIG. 2I) can be arcs (curvilinear segments) instead of chords (straight line segments).

FIG. 2C shows a magnified view of a portion of the dual-frequency patch antenna 200. A protrusion 224 on the inside radiator 204 is disposed partially within a corresponding groove 256 of the outside radiator 206. Similarly, a protrusion 254 on the outside radiator 206 is disposed partially within a corresponding groove 226 of the inside radiator 204. The inside radiator 204 and the outside radiator 206 are dielectrically isolated by the gap 218, which has a width δ 201. Typical values of δ are about 0.2-2 mm. In the example shown in FIG. 2C, the conducting element 208 is disposed within the corresponding protrusion 254. The conducting element 208 can also be disposed in a region adjacent to (in close proximity to) the corresponding protrusion 254, within the annular region of the outside radiator 206. The size of the region adjacent to the corresponding protrusion 254 is a user-defined design parameter.

For GNSS antennas, the DP should be maximally wide and uniform in the forward hemisphere (the hemisphere facing the sky). Refer to FIG. 2B. This DP can be achieved by a power supply system using, for example, the exciting pin 214 for the inside radiator 204 and the exciting pin 216 for the outside radiator 206. In this case, resonance oscillations matching the $TM_{11}$ mode are excited in both the inside radiator 204 and the outside radiator 206. Electromagnetic power can be supplied to each radiator with a coaxial cable; exciting pin 214 and exciting pin 216 can be the center conductors of the coaxial cables.

As discussed above, the ground plane 202 and the inside radiator 204 form an inside open resonator. Similarly, the ground plane 202 and the outside radiator 206 form an outside open resonator. The diameters $D_2$, $D_3$ and $D_5$ (see FIG. 2D and FIG. 2G) are selected such that the resonance oscillations are excited on the operating frequencies. These resonance oscillations can correspond to any resonator mode; the mode is selected to yield the desired DP.

For a dual-band antenna, the oscillations in the inside resonator are excited on the high frequency $f_1$, and the oscillations in the outside resonator are excited on the low frequency $f_2$. For GPS, the frequency $f_1$=1575 MHz corresponds to the mid-frequency of the high-frequency band $L_1$, and the frequency $f_2$=1227 MHz corresponds to the mid-frequency of the low-frequency band $L_2$. Capacitive coupling between the inside radiator 204 and the outside radiator 206 in the regions of the outside radiator 206 shorted to ground by the conducting elements 208 allows $D_1<0.5\lambda_1$ without a solid dielectric between the ground plane 202 and the portion of the dielectric substrate carrying the inside radiator 204 (see FIG. 2B). Here $\lambda_1$ is the free-space wavelength corresponding to frequency $f_1$.

The volume between the ground plane 202 and the portion of the dielectric substrate 210 carrying the outside radiator 206 can be partially or completely filled with a dielectric solid. In FIG. 2B, for example, dielectric supports 212 are disposed near the outer periphery of the outside radiator 206 such that $D_5<0.5\lambda_2$. Here $\lambda_2$ is the free-space wavelength corresponding to the frequency $f_2$.

The diameter $D_3$ and the diameter $D_5$ of the outside radiator 206 can both be reduced without decreasing the diameter $D_2$ of the inside radiator 204. As a consequence, the overall antenna dimensions are reduced, the DP and the operational bandwidth in the low-frequency band with central frequency $f_2$ are expanded, and the desired bandwidth in the high-frequency band with central frequency $f_1$ is maintained. Relatively low expansion of the DP in the high-frequency band prevents an increase in multipath reception in the high-frequency band.

Figure 2J:
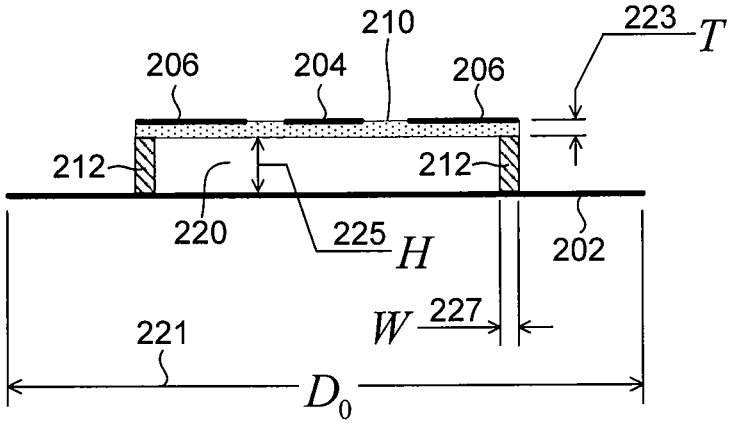

FIG. 2J shows other geometrical parameters that can be user-specified to yield the desired antenna characteristics. $D_0$ 221 is the diameter of the ground plane 202. T 223 is the thickness of the dielectric substrate 210. H 225 is the spacing between the dielectric substrate 210 and the ground plane 202. W 227 is a lateral dimension of the dielectric support 212. Typical values of $D_0$ are about 100-200 mm; typical values of T are about 0.5-2 mm; typical values of W are about 3-6 mm; and typical values of H are about 4-15 mm.

Figure 3A:
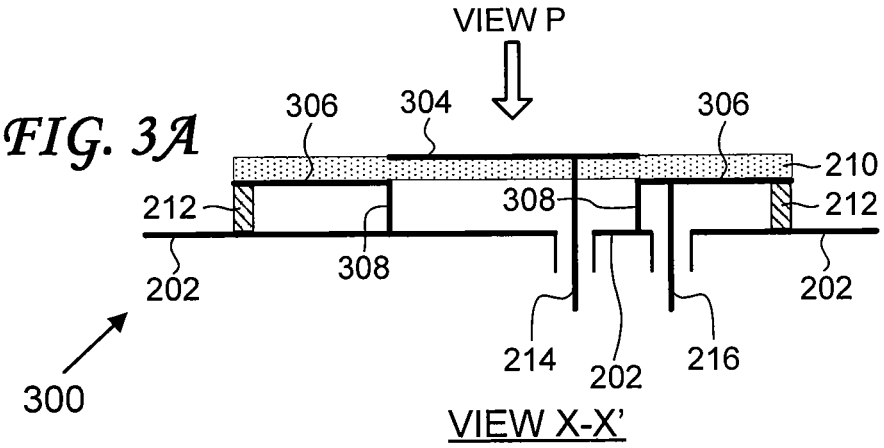
FIG. 3A-FIG. 3C show a dual-band patch antenna according to a second embodiment.
Figure 3B:
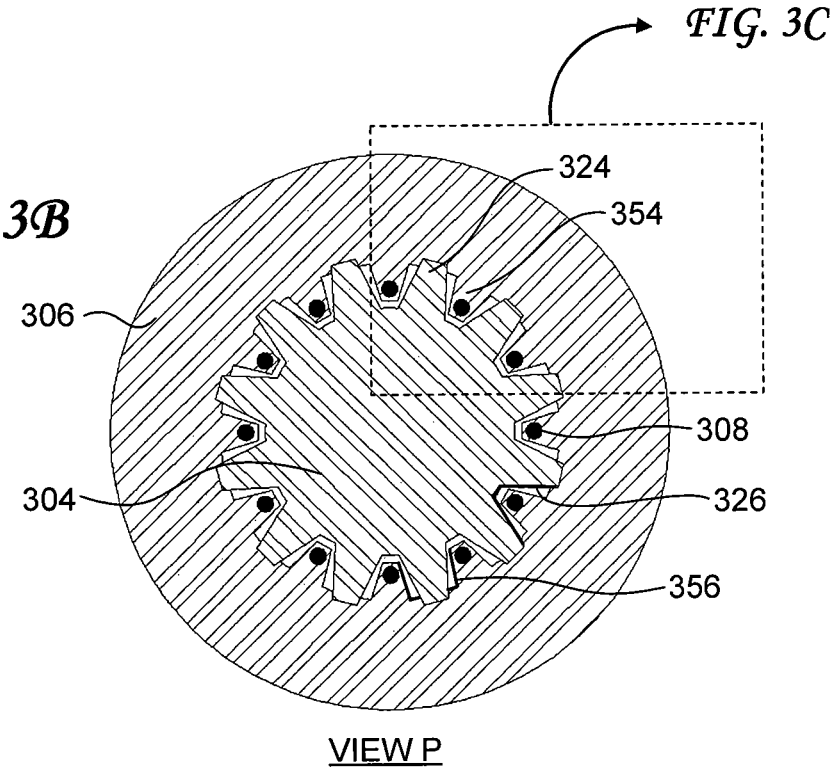
Figure 3C:
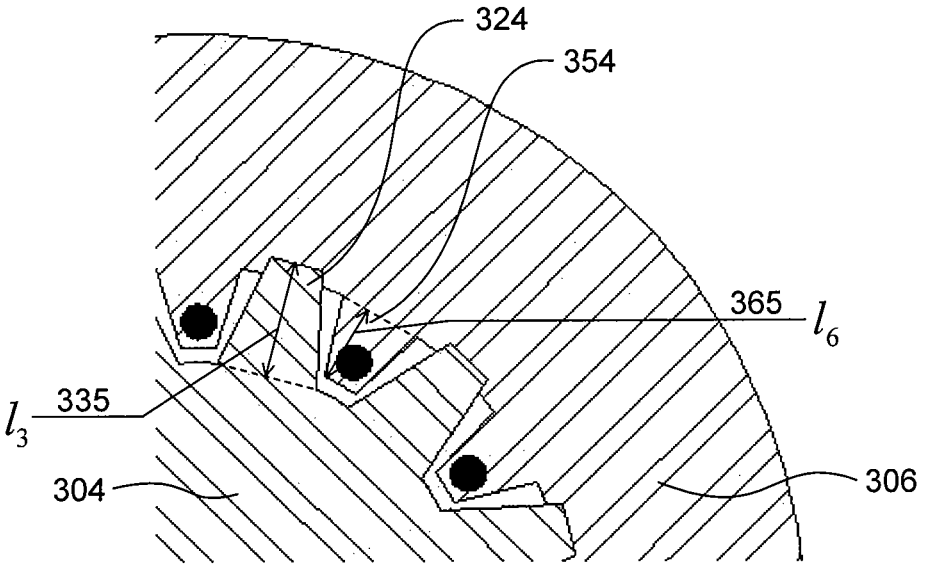

FIG. 3A-FIG. 3C show a dual-frequency patch antenna 300, according to a second embodiment of the invention. FIG. 3A shows a cross-sectional view, View X-X'. The inside radiator 304 is disposed on the top surface (facing away from the ground plane 202) of the dielectric substrate 210. The outside radiator 306 is disposed on the bottom surface (facing towards the ground plane 202) of the dielectric substrate 210. A set of conducting elements 308 electrically connect the outside radiator 306 to the ground plane 202.

FIG. 3B shows View P, which is a projection of the inside radiator 304, the outside radiator 306, and the set of conducting elements 308 onto the plane of the ground plane 202. Along the periphery of the inside radiator 304 are a series of protrusions 324 separated by a series of grooves 326. Along the inner periphery of the outside radiator 306 is a series of protrusions 354 separated by a series of grooves 356. In FIG. 3B, a representative groove 326 and a representative groove 356 are highlighted in bold lines. In the example shown in FIG. 3B, the conducting element 308 is disposed within the protrusion 354. The conducting element 308 can also be disposed in a region adjacent to the protrusion 354, within the annular region of the outside radiator 306.

The geometry is similar to that of the inside radiator 204, the outside radiator 206, and the set of conducting elements 208 in FIG. 2A. The magnified view in FIG. 3C, however, shows an advantage. In the dual-frequency patch antenna 200, both the inside radiator and the outside radiator are disposed on the same surface of the dielectric substrate. The protrusions and grooves on the inside radiator and the protrusions and grooves on the outside radiator, therefore, need to be configured such that there is no electrical contact between the inside radiator and the outside radiator. In the dual-frequency patch antenna 300, however, the inside radiator and the outside radiator are disposed on different surfaces of the dielectric substrate, and a greater range of design parameters are available.

Similar to the configuration in the dual-frequency patch antenna 200, the height $l_3$ 335 of a protrusion 324 can be the same as the height $l_6$ 365 of a protrusion 354. The height $l_3$ 335 of a protrusion 324, however, can now also be greater than the height $l_6$ 365 of a protrusion 354. The series of protrusions 324 along the periphery of the inside radiator 304 can project over the outside radiator 306. Consequently, the capacitive coupling between the internal radiator 304 and the outside radiator 306 can be greater than the capacitive coupling between the internal radiator 204 and the external radiator 206 in FIG. 2A, and the size of the internal radiator 304 can be further reduced from the size of the inside radiator 204.

Note that the geometry can also be configured such that (a) the series of protrusions 354 along the inner periphery of the outside radiator 306 projects under the inside radiator 304 and (b) the series of protrusions 324 along the periphery of the inside radiator 304 projects over the outside radiator 306, and the series of protrusions 354 along the inner periphery of the outside radiator 306 projects under the inside radiator 304. The configuration in which only the series of protrusions 324 along the periphery of the inside radiator 304 projects over the outside radiator 306 provides the greatest reduction in antenna dimensions.

Since the inside radiator and the outside radiator are vertically separated by a dielectric substrate, they can overlap without shorting. Herein, the two radiators overlap if the projections of the two radiators onto a reference plane parallel to the ground plane overlap (intersect). Examples of the reference plane include the ground plane, the top surface of the dielectric substrate, and the bottom surface of the dielectric substrate.

If the inside radiator is configured as a simple disc (without any structures such as grooves and protrusions along the periphery) and the outside radiator is configured as a simple ring (without any structures such as grooves and protrusions along the inner periphery), two variants of their disposition are possible. If the disc-shaped inside radiator is above the ring-shaped outside radiator and they overlap, then the bandwidth of the inside radiator becomes narrower because the patch of the outside radiator becomes the ground plane of the inside radiator in the region of the edge of the inside radiator. The vertical distance between the patches of the inside and outside radiators is small, and the overlap yields an equivalent reduction in the height of the patch over the ground plane; consequently, the operating bandwidth of the inside radiator decreases.

If the disc-shaped inside radiator is under the ring-shaped outside radiator and they overlap, coupling between them is increased since the patch edge of the inside radiator enters into the cavity of the outside radiator and excites an electromagnetic field in it. The increase in cross-coupling between the two radiators makes their coupling with the power feed line more difficult.

In the configuration shown in FIG. 2A and FIG. 2B, the inside radiator and the outside radiator are co-planar and do not overlap. In the configuration shown in FIG. 3A and FIG. 3B, the overlap regions are tightly controlled by the configurations of the protrusions and grooves in the inside radiator and the outside radiator, resulting in a decrease of the dimensions of both the inside radiator and the outside radiator. By varying the configurations of the protrusions and the grooves, the antenna characteristics can be precisely tuned. Placement of the inside radiator and the outside radiator on opposite sides of a dielectric substrate allows for more flexibility in design.

Figure 4A:
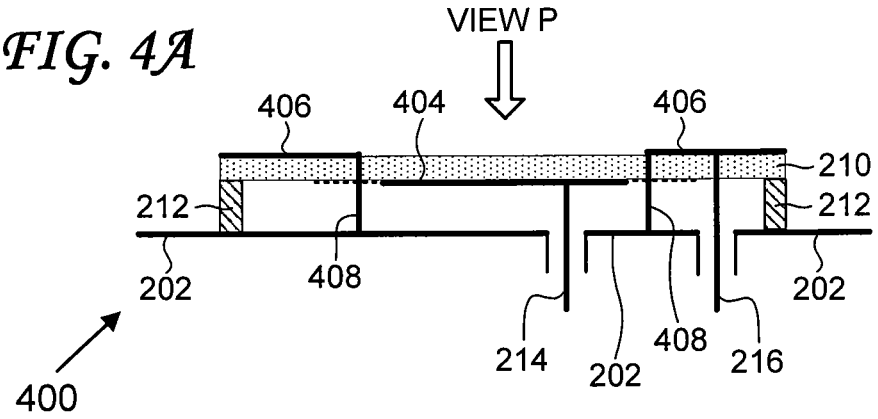
FIG. 4A and FIG. 4B show a dual-band patch antenna according to a third embodiment.
Figure 4B:
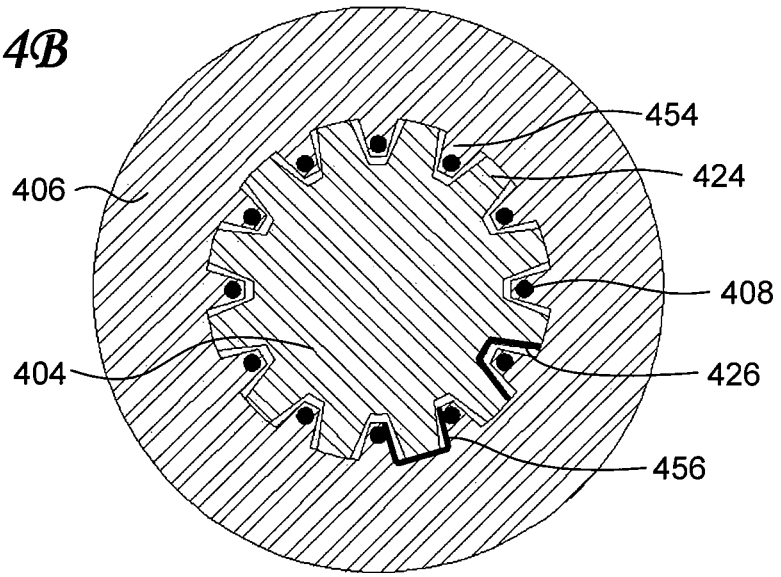

FIG. 4A and FIG. 4B show a dual-frequency patch antenna 400, according to a third embodiment of the invention. FIG.

4A shows a cross-sectional view, View X-X'. The inside radiator 404 is disposed on the bottom surface (facing towards the ground plane 202) of the dielectric substrate 210. The outside radiator 406 is disposed on the top surface (facing away from the ground plane 202) of the dielectric substrate 210. A set of conducting elements 408 electrically connect the outside radiator 406 to the ground plane 202.

FIG. 4B shows View P, which is a projection of the inside radiator 404, the outside radiator 406, and the set of conducting elements 408 onto the plane of the ground plane 202. The geometry is similar to that of the inside radiator 204, the outside radiator 206, and the set of conducting elements 208 in FIG. 2A. Along the periphery of the inside radiator 404 are a series of protrusions 424 separated by a series of grooves 426. Along the inner periphery of the outside radiator 406 is a series of protrusions 454 separated by a series of grooves 456. In FIG. 4B, a representative groove 426 and a representative groove 456 are highlighted in bold lines. Similar to the configuration described in FIG. 3B and FIG. 3C, the height of a protrusion 424 can be the same as the height of a protrusion 454. The height of a protrusion 424 can also be greater than the height of a protrusion 454. In this instance, the series of protrusions 424 project under the outside radiator 406. In the example shown in FIG. 4B, the conducting element 408 is disposed within the protrusion 454. The conducting element 408 can also be disposed in a region adjacent to the protrusion 454, within the annular region of the outside radiator 406.

Figure 5A:
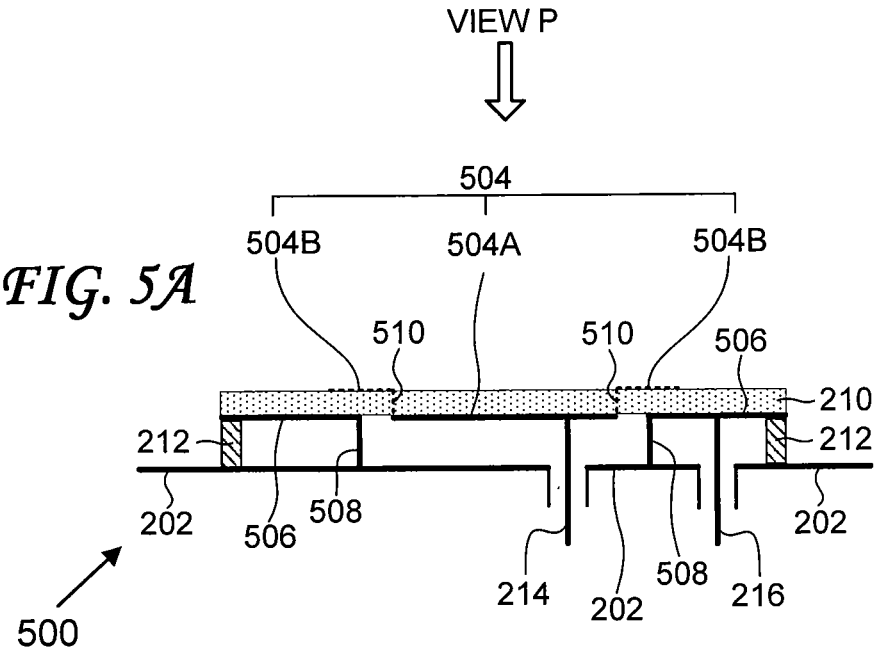
FIG. 5A and FIG. 5B show a dual-band patch antenna according to a fourth embodiment.
Figure 5B:
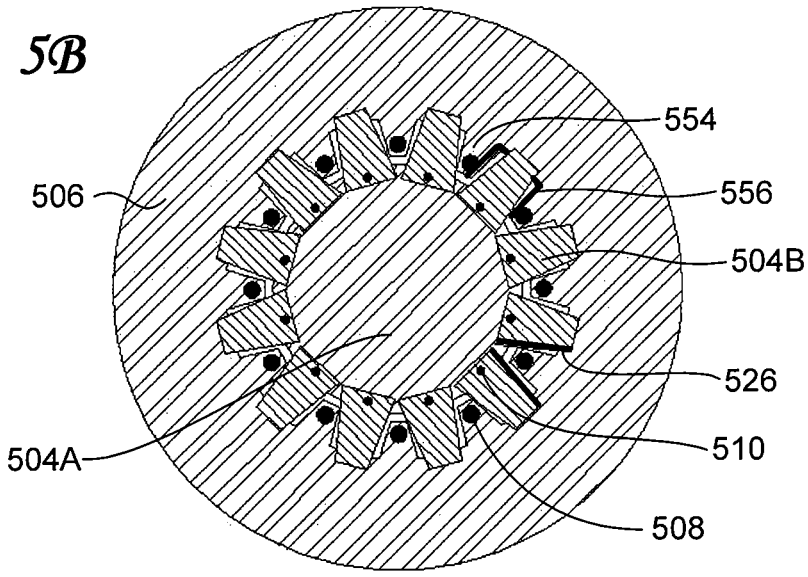

FIG. 5A and FIG. 5B show a dual-frequency patch antenna 500, according to a fourth embodiment of the invention. FIG. 5A shows a cross-sectional view, View X-X'. The inside radiator 504 includes the inside radiator portion 504A disposed on the bottom surface of the dielectric substrate 210 and the inside radiator portion 504B disposed on the top surface of the dielectric substrate 210; the geometry of the inside radiator 504 is discussed in more detail below. A set of conducting elements 510 electrically connect the inside radiator portion 504A and the inside radiator portion 504B. The set of conducting elements 510 can, for example, be conducting pins or plated (metallized) vias.

The outside radiator 506 is disposed on the bottom surface of the dielectric substrate 210. A set of conducting elements 508 electrically connect the outside radiator 506 to the ground plane 202.

FIG. 5B shows View P, which is a projection of the inside radiator 504, the outside radiator 506, the set of conducting elements 508, and the set of conducting elements 510 onto the plane of the ground plane 202. The inside radiator portion 504A has a circular geometry. The inside radiator portion 504B includes a set of segments similar to the protrusions 224 in FIG. 2C. The set of segments is also referred to herein as a set of protrusions. The set of segments is separated by a set of grooves 526. In FIG. 5B, a representative groove 526 is highlighted in bold lines. The set of segments can be dielectrically isolated from each other, or they can make electrical contact along the inner periphery, in the region of the set of conducting elements 510.

The geometry of the outside radiator 506 is similar to that of the outside radiator 206 shown in FIG. 2C. Along the inner periphery of the outside radiator 506 is a series of protrusions 554 separated by a series of grooves 556. In FIG. 5B, a representative groove 556 is highlighted in bold lines. A segment 504B can project over a corresponding groove 556 only. A segment 504B can also project over both a corresponding groove 556 and a portion of the annular region of the outside radiator 506. In the example shown in FIG. 5B, the conducting element 508 is disposed within the protrusion 554. The conducting element 508 can also be disposed in a region adjacent to the protrusion 554, within the annular region of the outside radiator 506.

Figure 6A:
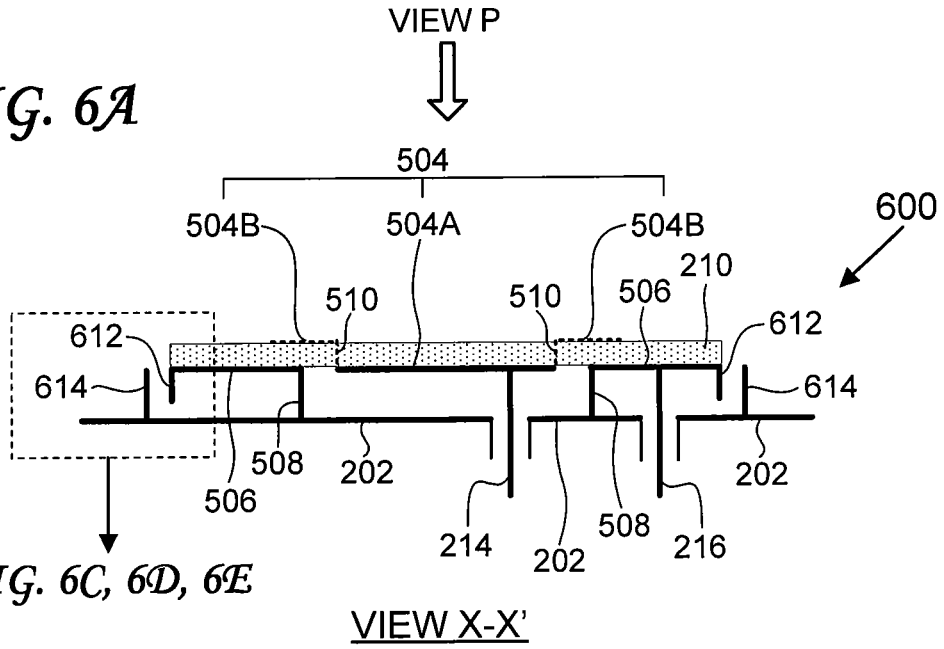
FIG. 6A-FIG. 6E show a dual-band patch antenna according to a fifth embodiment.
Figure 6B:
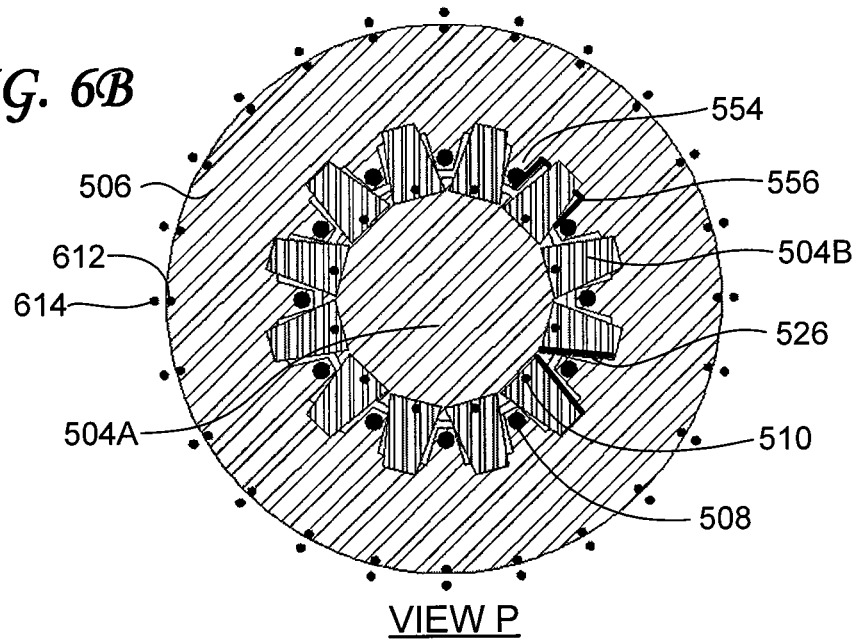

FIG. 6A (cross-sectional view, View X-X') and FIG. 6B (projection view, View P) show a dual-frequency patch antenna 600, according to a fifth embodiment of the invention. The dual-frequency patch antenna 600 is similar to the dual-frequency patch antenna 500, except a set of capacitive elements 612 is disposed around the outer periphery of the outside radiator 506, and a set of capacitive elements 614 is disposed on the ground plane 202 adjacent to the set of capacitive elements 612. The capacitive elements allow a reduction in size of the patch antenna and an increase in the directional pattern of the patch antenna, especially when the dielectric medium between the ground plane 202 and the dielectric substrate 210 is air instead of a high-permittivity dielectric solid. The capacitive elements, for example, can be conductive metal pins or conductive thin metal sheets. The set of capacitive elements 612 can be soldered to the outside radiator 506 or integrally fabricated. Similarly, the set of capacitive elements 614 can be soldered onto the ground plane 202 or integrally fabricated. Other standard methods for forming an electrical bond can be used instead of soldering.

Figure 6C:
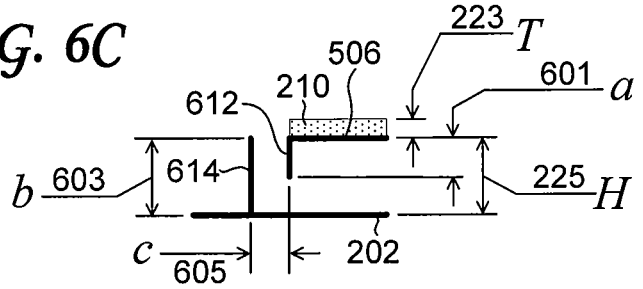
Figure 6D:
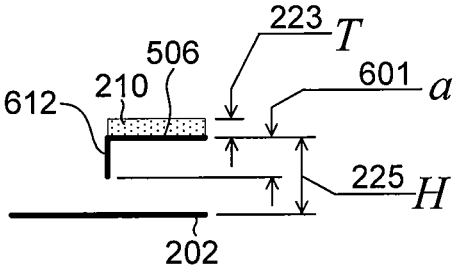
Figure 6E:
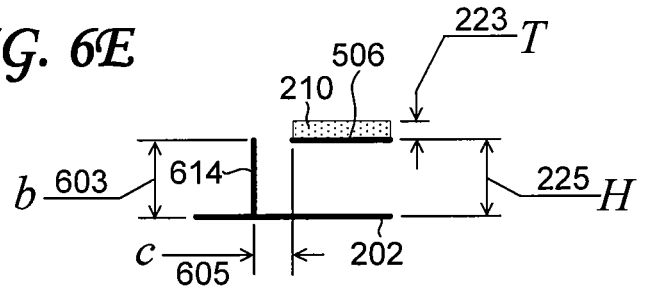

FIG. 6C, FIG. 6D, and FIG. 6E show magnified views of three configurations of the capacitive elements. In FIG. 6C, the set of capacitive elements 612 and the set of capacitive elements 614 are both present. In FIG. 6D, only the set of capacitive elements 612 is present. In FIG. 6E, only the set of capacitive elements 614 is present. The length of a capacitive element 612 is a 601. The length of a capacitive element 614 is b 603. The lengths are measured along a direction normal to the ground plane 202. The lateral spacing (measured in a direction along the ground plane 202) is C 605. The values of a, b, and C can be user-specified to provide the desired antenna characteristics. Note that a<H; however, b can be less than, equal to, or greater than H. Typical values of a are about 0.1-14 mm; typical values of b are about 0-15 mm; and typical values of C are about 0.5-3 mm.

The ground plane 202 can have a larger lateral dimension than the outside radiator 506. The periphery of the ground plane 202 can also have a different shape from the outer periphery of the outside radiator 506. In general, the set of capacitive elements 614 is disposed along a path that is on or within the periphery of the ground plane 202. The path is typically geometrically similar to the outer periphery of the outside radiator. Two objects are geometrically similar if they have the same shape.

Note that the sets of capacitive elements can be added to other embodiments of the patch antenna (such as those previously described above and additional embodiments described below).

Figure 7A:
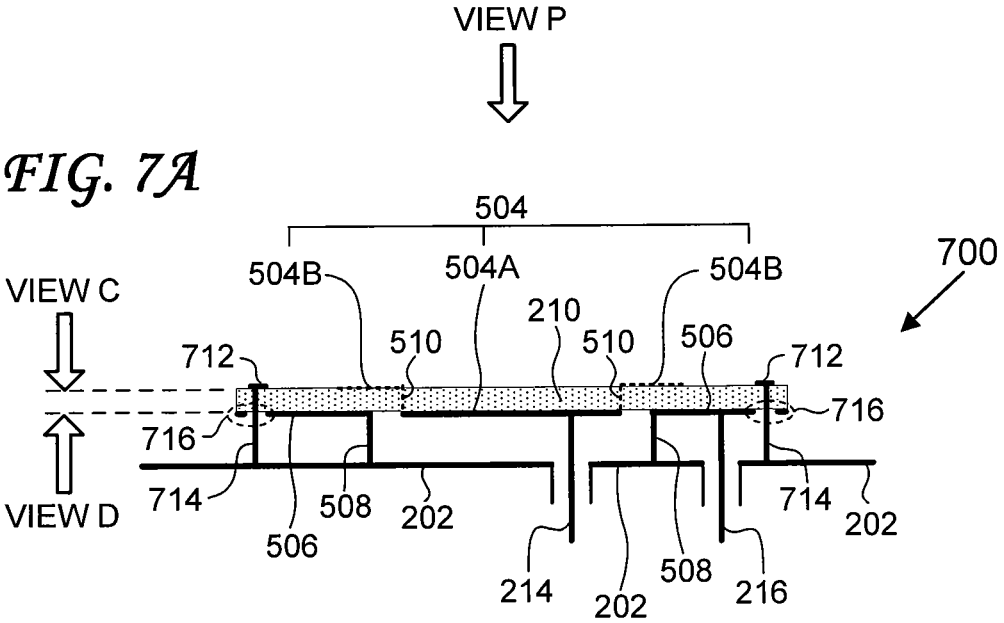
FIG. 7A-FIG. 7D show a dual-band patch antenna according to a sixth embodiment.

FIG. 7A-FIG. 7D show a dual-frequency patch antenna 700, according to a sixth embodiment of the invention. FIG. 7A shows a cross-sectional view, View X-X'. The dual-frequency patch antenna 700 is similar to the dual-frequency patch antenna 600, except for the configuration of the capacitive elements. In FIG. 7A, the set of capacitive elements 714 terminate on the top surface of the dielectric substrate 210 at a set of contact pads 712 and terminate on the ground plane 202. The set of capacitive elements 714 passes through a set of holes 716 in the outside radiator 506 and through a set of holes in the dielectric substrate 210. There is no electrical contact between the set of capacitive elements 714 and the outside radiator 506.

Figure 7B:
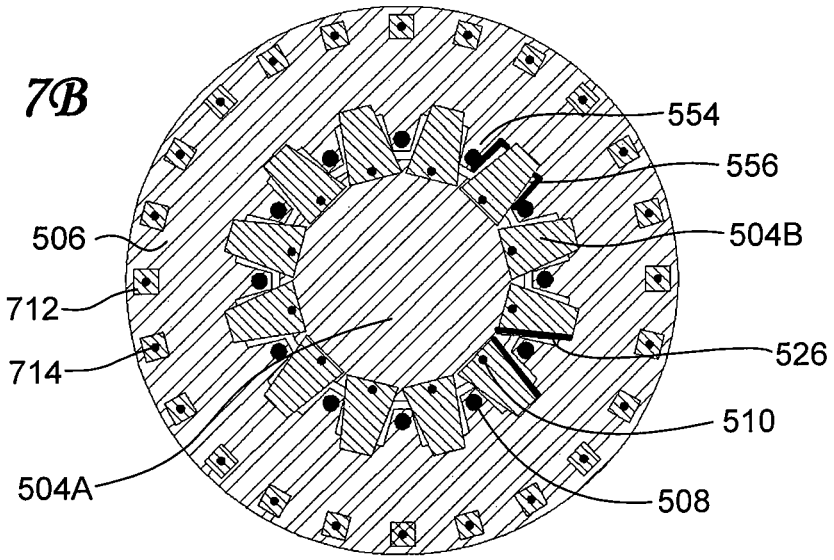
Figure 7C:
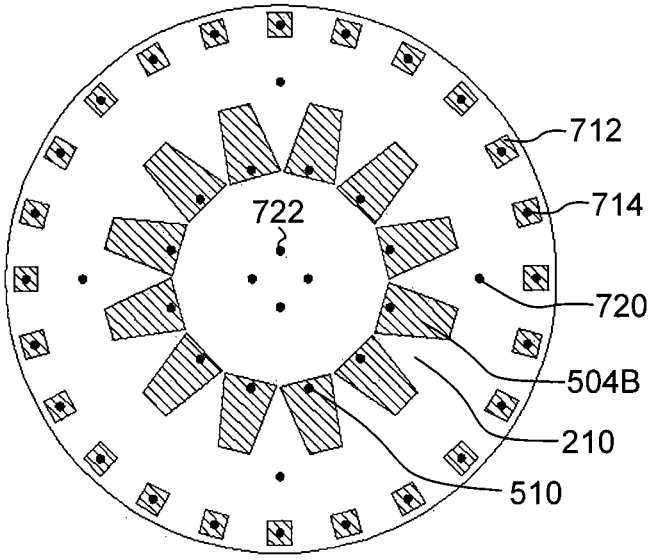
Figure 7D:
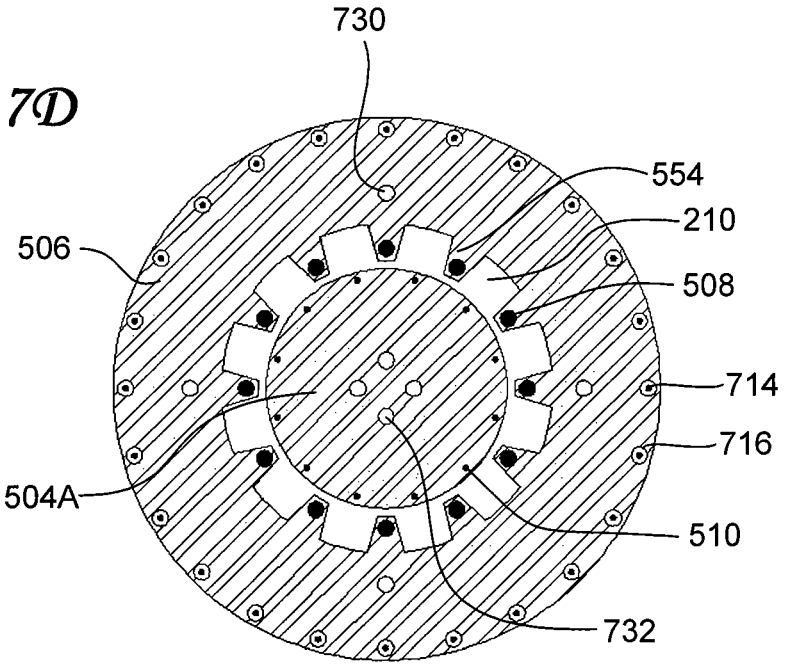

FIG. 7B shows a projection view, View P, in which the inside radiator 504, the outside radiator 506, the set of conducting elements 508, the set of conducting elements 510, the set of capacitive elements 714, and the set of contact pads 712 are projected onto the plane of the ground plane 202. FIG. 7C shows a view, View C, of the top surface of the dielectric substrate 210. FIG. 7D shows a view, View D, of the bottom surface of the dielectric substrate 210. Shown in FIG. 7D are a set of exciting pins 730 and a set of exciting pins 730. These sets of exciting pins pass through the set of via holes 720 and the set of via holes 732, respectively.

Figure 8A:
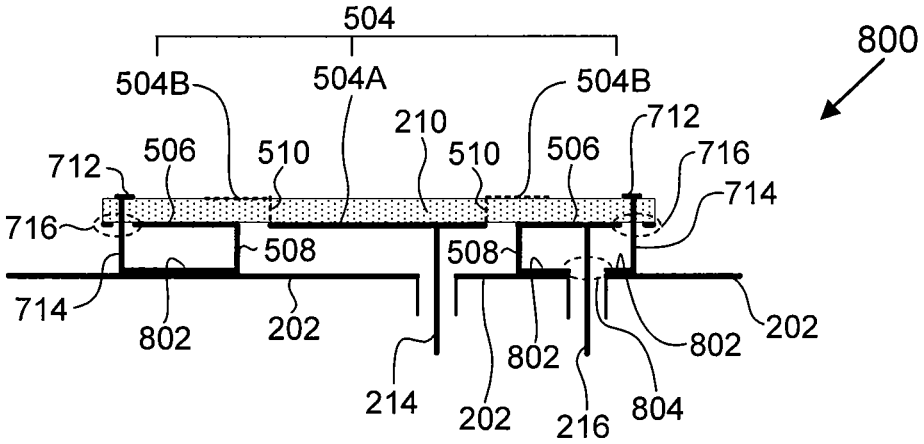
FIG. 8A and FIG. 8B show a dual-band patch antenna according to a seventh embodiment.
Figure 8B:
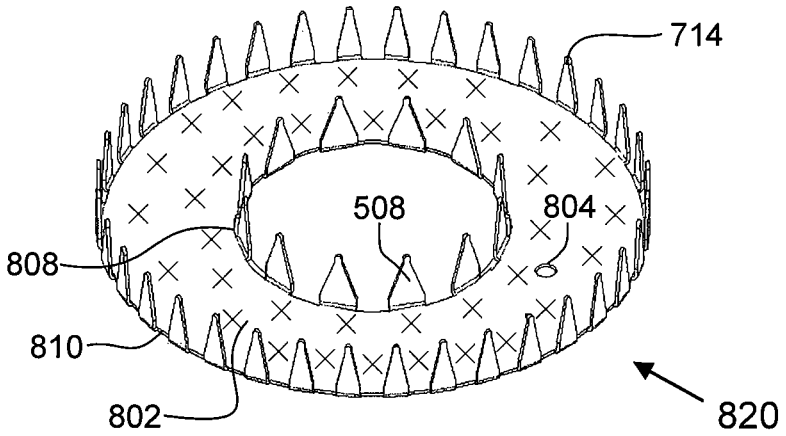

FIG. 8A and FIG. 8B show a dual-frequency patch antenna 800, according to a seventh embodiment of the invention. FIG. 8A shows a cross-sectional view (View X-X'). The set of capacitive elements 714 and the set of conducting elements 508 are fabricated as an integrated assembly 820 from a single sheet of metal, as shown in FIG. 8B (perspective view). The assembly 820 includes an annular base 802 with an inner periphery 808 and an outer periphery 810. The hole 804 allows clearance for the center conductor 216. The set of capacitive elements 714 is configured along the outer periphery 810. The set of conducting elements 508 is configured along the inner periphery 808. The set of capacitive elements 714 and the set of conducting elements 508 are first cut into a flat sheet of metal; they are then bent substantially orthogonal to the annular base 802. The annular base 802 is electrically connected to the ground plane 202. Note that the assembly 820 supports the dielectric substrate 210 above the ground plane 202.

Figure 9A:
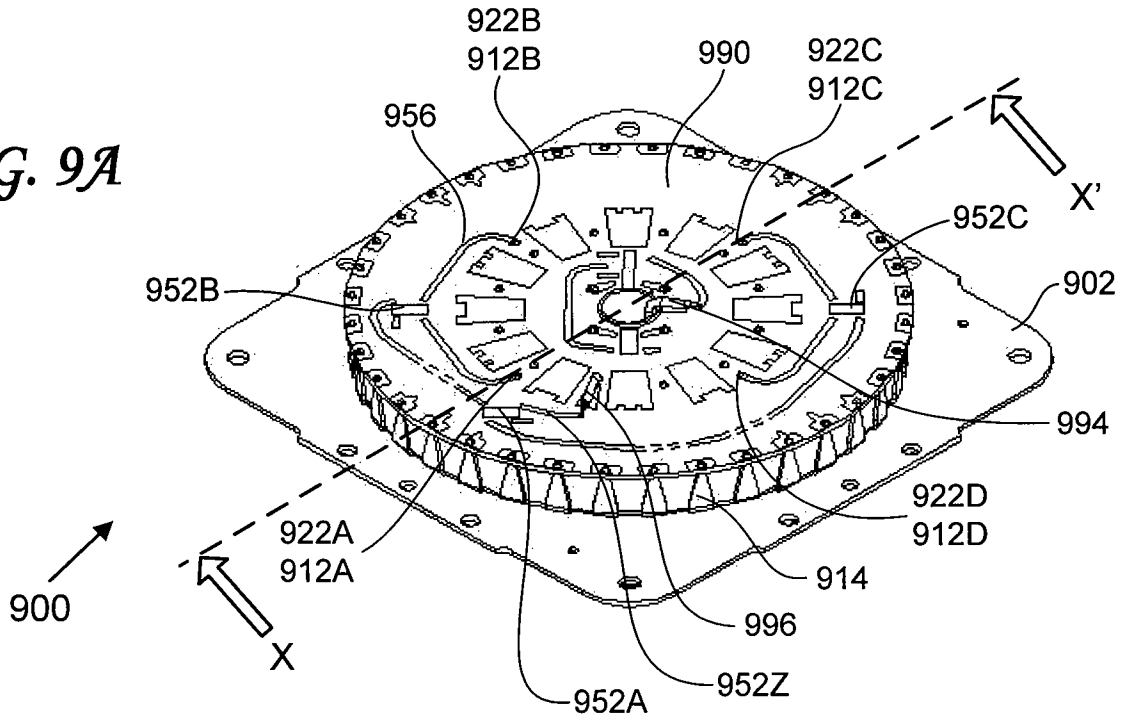
FIG. 9A-FIG. 9F show a dual-band patch antenna according to an eighth embodiment.

FIG. 9A-FIG. 9F show a dual-frequency patch antenna 900, according to an eighth embodiment of the invention. FIG. 9A shows a perspective view. The ground plane 902 is fabricated as a square metal plate. The radiators (described below) are formed from metal films disposed on a printed circuit board (PCB) 990, which is supported above the ground plane 902 by a set of capacitive elements 914.

Figure 9B:
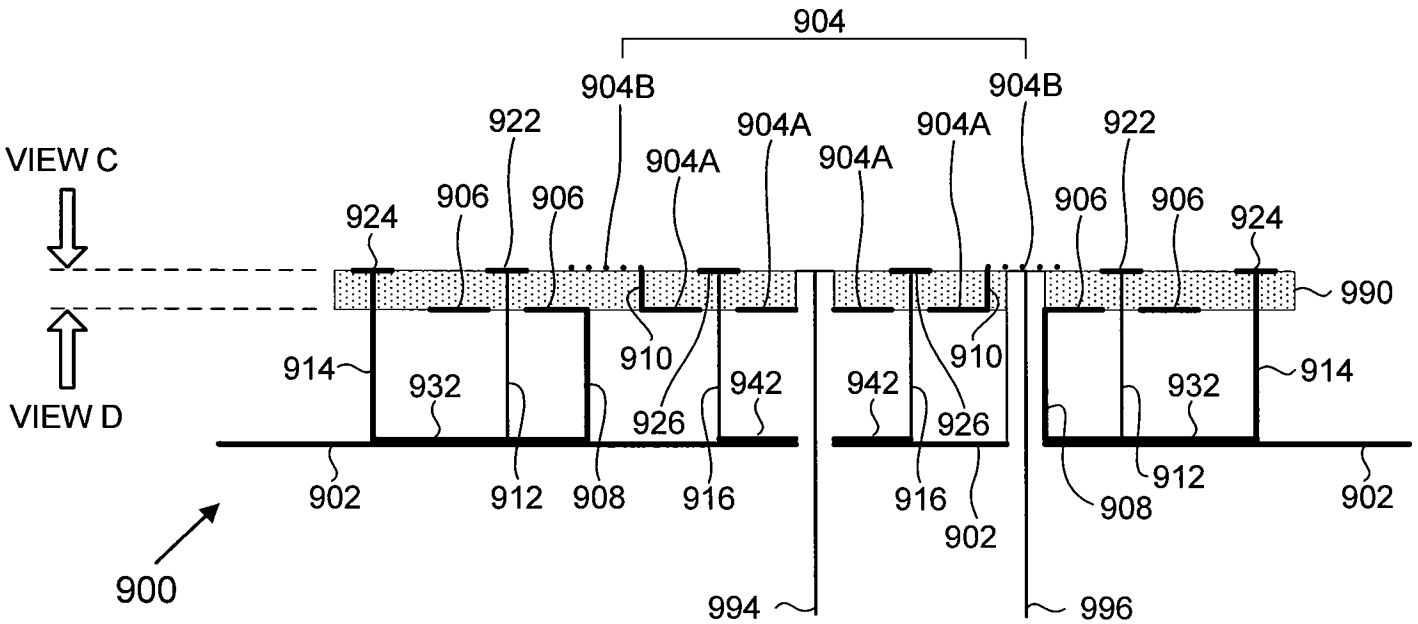

FIG. 9B shows a cross-sectional view, View X-X'. The inside radiator 904 includes the inside radiator portion 904A disposed on the bottom surface of the PCB 990 and the inside radiator portion 904B disposed on the top surface of the PCB 990; the geometry of the inside radiator 904 is discussed in more detail below. A set of conducting elements 910 electrically connects the inside radiator portion 904A and the inside radiator portion 904B. The set of conducting elements 910 can, for example, be conducting pins or plated (metallized) vias. The outside radiator 906 is disposed on the bottom surface of the PCB 990. A set of conducting elements 908 electrically connects the outside radiator 906 to the ground plane 902.

Shown in FIG. 9B are a set of exciting pins 912 for the outside radiator 906 and a set of exciting pins 916 for the internal radiator 904. Each exciting pin 912 is electrically connected at one end to the ground plane 902 and is electrically connected at the other end to a contact pad 922 disposed on the top surface of the PCB 990. Each exciting pin 916 is electrically connected at one end to the ground plane 902 and is electrically connected at the other end to a contact pad 926 disposed on the top surface of the PCB 990.

Also shown in FIG. 9B is a set of capacitive elements 914. Each capacitive element 914 is electrically connected at one end to the ground plane 902 and is electrically connected at the other end to a contact pad 924 disposed on the top surface of the PCB 990.

Figure 9C:
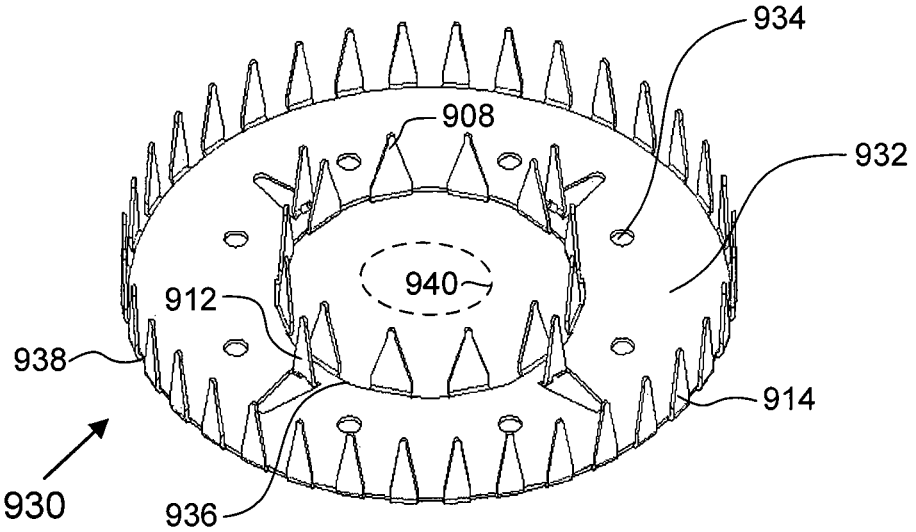
Figure 9D:
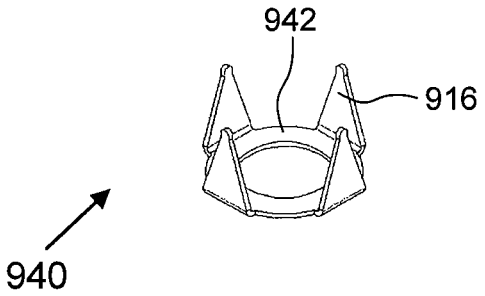
Figure 9E:
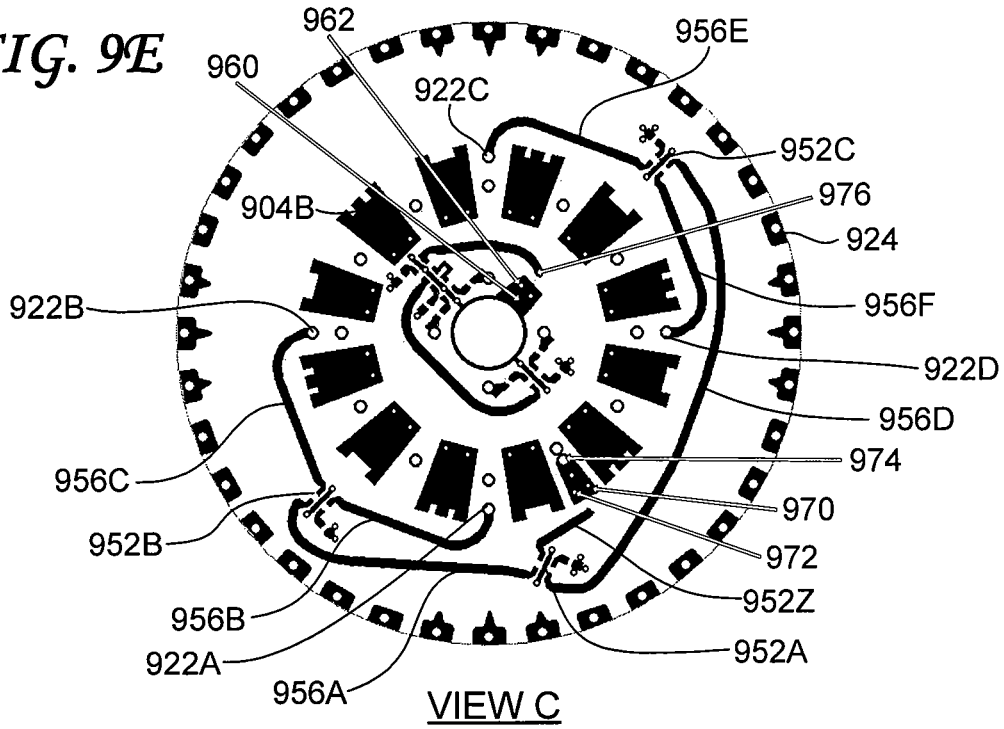
Figure 9F:
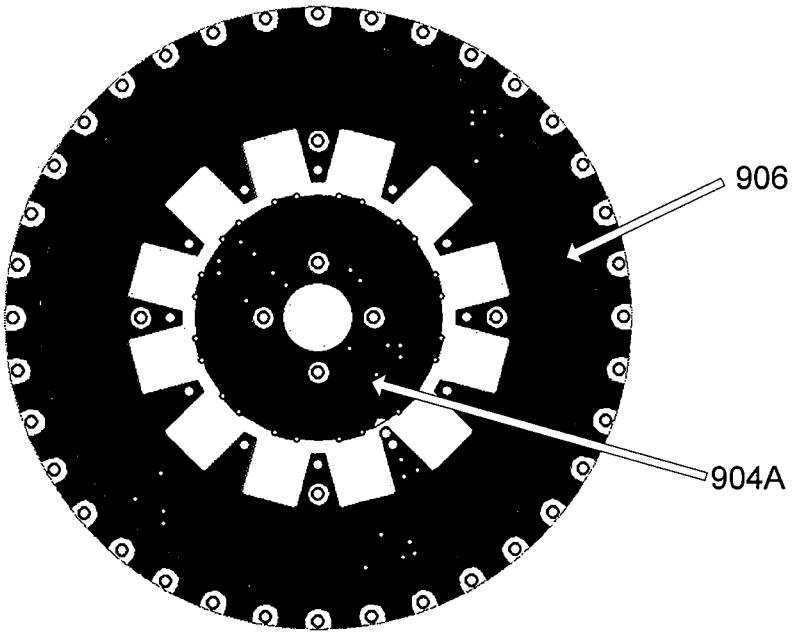

FIG. 9E shows View C, a view of the top surface of the PCB 990. FIG. 9F shows View D, a view of the bottom surface of the PCB 990. Dark areas represent metallization. Refer to FIG. 9F. Shown are the outside radiator 906 and the inside radiator portion 904A. Refer to FIG. 9E. Shown are the inside radiator portion 904B, which includes a set of segments similar to the protrusions 224 in FIG. 2C and the set of contact pads 924.

In an embodiment, the set of capacitive elements 914, the set of conducting elements 908, and the set of exciting pins 912 are fabricated as an integrated assembly 930 from a single sheet of metal, as shown in FIG. 9C (perspective view). The assembly 930 includes an annular base 932 with an inner periphery 936 and an outer periphery 938. The set of holes 934 allow clearance for mounting screws to attach an auxiliary circuit board (not shown) to the ground plane 902. The auxiliary circuit board, for example, can be a carrier for a low-noise amplifier (LNA). The set of capacitive elements 914 are configured along the outer periphery 938. The set of conducting elements 908 are configured along the inner periphery 936. The set of exciting pins 912 is configured in between the set of capacitive elements 914 and the set of conducting elements 908. The set of capacitive elements 914, the set of conducting elements 908, and the set of exciting pins 912 are first cut into a flat sheet of metal; they are then bent substantially orthogonal to the annular base 932. The annular base 932 is electrically connected to the ground plane 902.

Refer to FIG. 9B, FIG. 9E, and FIG. 9F. Each capacitive element 914 is inserted through a hole in the PCB 990 and soldered onto a contact pad 924. Each conducting element 908 is inserted through a hole in the PCB 990 and soldered onto the outside radiator 906. Each exciting pin 912 is inserted through a hole in the PCB 990 and soldered onto a contact pad 922. Other standard methods for forming electrical bonds can be used instead of soldering.

In an embodiment, the set of exciting pins 916 is fabricated as an integrated assembly 940 from a single sheet of metal, as shown in FIG. 9D (perspective view). The assembly 940 includes an annular base 942. The set of exciting pins 916 is configured along the outer periphery of the annular base 942. Note that the assembly 940 can be disposed within the assembly 930 (as indicated by the dotted ellipse in FIG. 9C). Each exciting pin 916 is inserted through a hole in the PCB 990 and soldered onto a contact pad 926.

The patch antenna 900 is fed by a power feed system that has two inputs (one for the high-frequency band and one for the low-frequency band) and eight outputs.

The power feed system for the outside radiator 906 is described in detail. Refer to FIG. 9B. The coax cable 996 is inserted through a hole in the ground plane 902 and a hole 974 (FIG. 9E) in the PCB 990. The shield (braid) of the coax cable 996 is connected to the ground plane 902 and the outside radiator 906. Refer to FIG. 9A and FIG. 9E. The coax cable 996 is positioned close to one of the conducting elements 908 to minimize the effects of the coax cable 996 on the radiator operation. The shield of the coax cable 996 is electrically connected (for example, by a solder bond) to the contact pad 970. The contact pad 970 is electrically connected to the outside radiator 906 by the metallized vias 972.

The center conductor of the coax cable 996 is electrically connected to the microstripline 952Z, which is electrically connected to the input of the quadrature splitter 952A. One output of the quadrature splitter 952A is electrically connected to the microstripline 956A, which is electrically connected to the input of the quadrature splitter 952B. One output of the quadrature splitter 952B is electrically connected to the microstripline 956B, which is electrically connected to the contact pad 922A, which in turn is electrically connected to the exciting pin 912A. The other output of the quadrature splitter 952B is electrically connected to the microstripline 956C, which is electrically connected to the contact pad 922B, which in turn is electrically connected to the exciting pin 912B.

The other output of the quadrature splitter 952A is electrically connected to the microstripline 956D, which is electrically connected to the input of the quadrature splitter 952C. One output of the quadrature splitter 952C is electrically connected to the microstripline 956E, which is electrically connected to the contact pad 922C, which in turn is electrically connected to the exciting pin 912C. The other output of the quadrature splitter 952C is electrically connected to the microstripline 956F, which is electrically connected to the contact pad 922D, which in turn is electrically connected to the exciting pin 912D. Note that the outside radiator 906 serves as a ground plane for the microstriplines.

Power is fed through the center conductor of the coax cable 996 through the microstriplines, quadrature splitters, and the contact pads to the exciting pin 912A, exciting pin 912B, exciting pin 912C, and exciting pin 912D. Referenced to the power at exciting pin 912A, the power at exciting pin 912B has a phase shift of 90 deg, the power at exciting pin 912C has a phase shift of 180 deg, and the power at exciting pin 912D has a phase shift of 270 deg. Circularly-polarized signals are therefore excited.

The power feed system for the inside radiator 904 is similar to the one described above for the outside radiator 906. Refer to FIG. 9B. The coax cable 994 is inserted through a hole in the ground plane 902 and a hole in the PCB 990. The shield (braid) of the coax cable 994 is electrically connected to the ground plane 902 and the inside radiator 904. The coax cable 994 is positioned close to the center of the antenna to minimize the effects of the cable 994 on radiator operation. The shield of the coax cable 994 is electrically connected to the contact pad 960. The contact pad 960 is electrically connected with the inside radiator 904 by the metallized vias 962. The center conductor of the coax cable 994 is electrically connected with the microstripline 976. Power is fed through the center conductor of the coax cable 994 through microstriplines, quadrature splitters, and contact pads to four exciting pins 916.

In the embodiment shown in FIG. 9A-FIG. 9F, a circularly-polarized antenna with four exciting pins in each radiator has been described. In another embodiment, the excitation system of the circularly-polarized antenna can include at least two exciting pins for each band to provide excitation of electric field for two orthogonal polarizations with a 90 deg phase shift. The exciting pins are fed by a quadrature power splitter or other coupler.

Note: In the transmit mode, each coax cable is coupled to the output of a transmitter. In the receive mode, each coax cable is coupled to the input of a receiver.

In the embodiments described above, radiators had circular geometries, and ground planes had circular or square geometries. In general, the geometric shape of the radiators and the ground plane can be independently specified. The geometric shape of each can be circular, square, elliptical, rectangular, or other user-specified geometry.

Excluding the protrusions and grooves, the geometric shape of the inside radiator is defined by a periphery (boundary). The inside radiator includes the periphery and the region within the periphery. Excluding the protrusions and grooves, the geometric shape of the outside radiator is defined by an inner periphery (inner boundary) and an outer periphery (outer boundary). The outside radiator includes the inner periphery, the outer periphery, and the region between the inner periphery and the outer periphery. In geometry, an "annulus" refers specifically to a circular ring; in general, a "ring" can have a circular or non-circular geometry. Herein, the geometry of the outside radiator is a "ring" with a user-defined geometry.

Examples of non-circular geometries are described below.

Figure 10B:
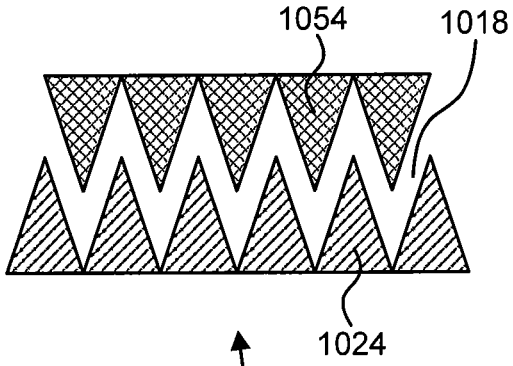
FIG. 10A and FIG. 10B show a dual-band patch antenna according to a ninth embodiment.
Figure 10A:
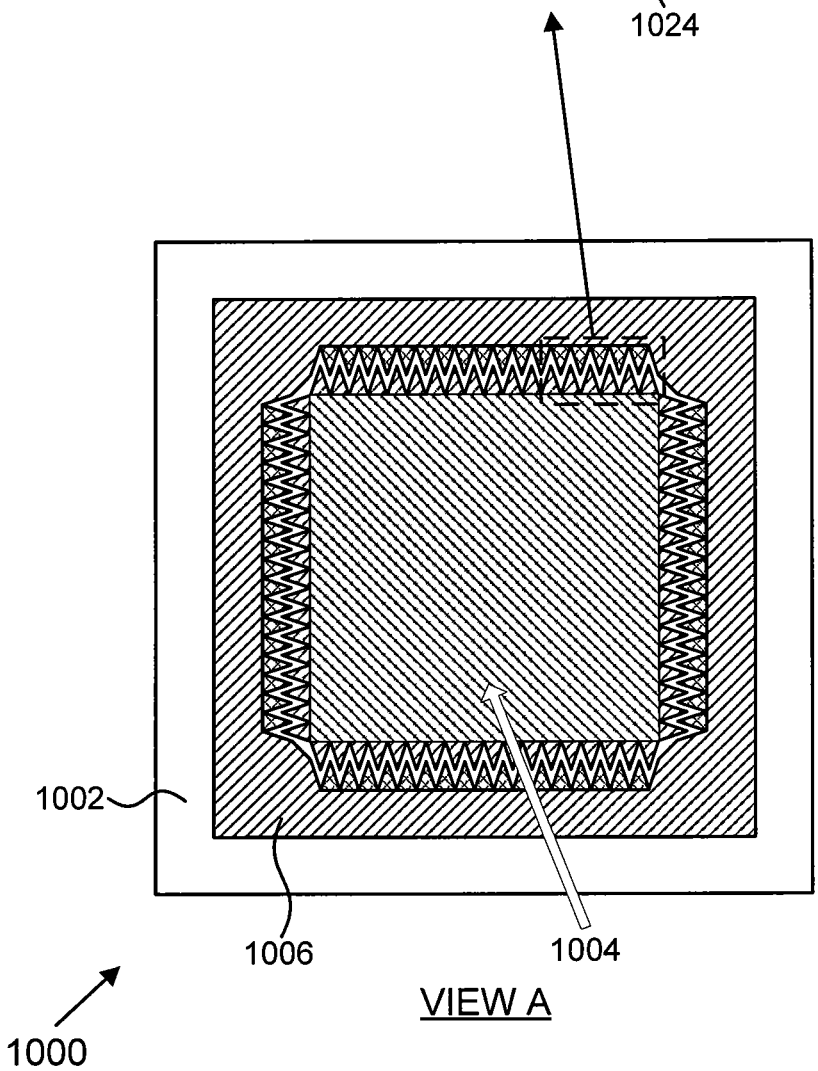

FIG. 10A (plan view, View A) shows a dual-frequency patch antenna 1000, according to a ninth embodiment. The dual-frequency patch antenna 1000 includes a conducting ground plane 1002, an inside radiator 1004, and an outside radiator 1006. The ground plane 1002, the inside radiator 1004, and the outside radiator 1006 each have a rectangular shape, typically a square shape; in particular, the shape of the outside radiator 1006 is nominally a rectangular ring. FIG. 10A shows a view similar to that of FIG. 2A for a dual-frequency patch antenna with a circular geometry. To simplify the drawing, other features, such as a set of conducting elements that electrically connect the outside radiator 1006 with the ground plane 1002 (similar to the set of conducting elements 208 in FIG. 2A) are not shown.

Around the periphery of the inside radiator 1004 is a series of protrusions 1024. Along the inner periphery of the outside radiator 1006 is a series of protrusions 1054. Details of these protrusions are shown in the magnified view of FIG. 10B. In this embodiment, a protrusion is characterized as a triangle. The two series of triangles are interdigitated such that a portion of a triangle in the series of protrusions 1024 is disposed within a 'V' between two adjacent triangles in the series of protrusions 1054 and a portion of a triangle in the series of protrusions 1054 is disposed within a 'V' between two adjacent triangles in the series of protrusions 1024. A 'V' corresponds to a groove (as shown, for example, in 2C). The series of protrusions 1024 and the series of protrusions 1054 are separated by the gap 1018. The series of protrusions 1024 and the series of protrusions 1054 can have other geometries; for example, a linear array of protrusions and grooves similar to those shown in FIG. 2A.

In FIG. 10A, both the inside radiator 1004 and the outside radiator 1006 are disposed on the same surface of a dielectric substrate (not shown); the configuration is similar to that shown in FIG. 2B. In other embodiments, the inside radiator 1004 and the outside radiator 1006 are disposed on opposite surfaces of a dielectric substrate, similar to the configurations shown in FIG. 3A, FIG. 4A, FIG. 5A, FIG. 6A, FIG. 7A, FIG. 8A, and FIG. 9A.

The embodiments described above (FIG. 2A-FIG. 2J, FIG. 3A-FIG. 3C, FIG. 4A and FIG. 4B, FIG. 5A and FIG. 5B, FIG. 6A-FIG. 6E, FIG. 7A-FIG. 7D, FIG. 8A and FIG. 8B, FIG. 9A-FIG. 9F, and FIG. 10A and FIG. 10B) were configured for circularly-polarized electromagnetic radiation. Similar embodiments, with appropriate changes in the feeds, can be configured for linearly-polarized electromagnetic radiation. In general, an excitation system for the inside radiator can excite circularly-polarized electromagnetic radiation or linearly-polarized electromagnetic radiation, and an excitation system for the outside radiator can excite circularly-polarized electromagnetic radiation or linearly-polarized electromagnetic radiation. The excitation system for the inside radiator can operate independently of the excitation system for the outside radiator.

FIG. 11A and FIG. 11B and FIG. 12A and FIG. 12B show embodiments configured for linearly-polarized radiation only.

Figure 11A:
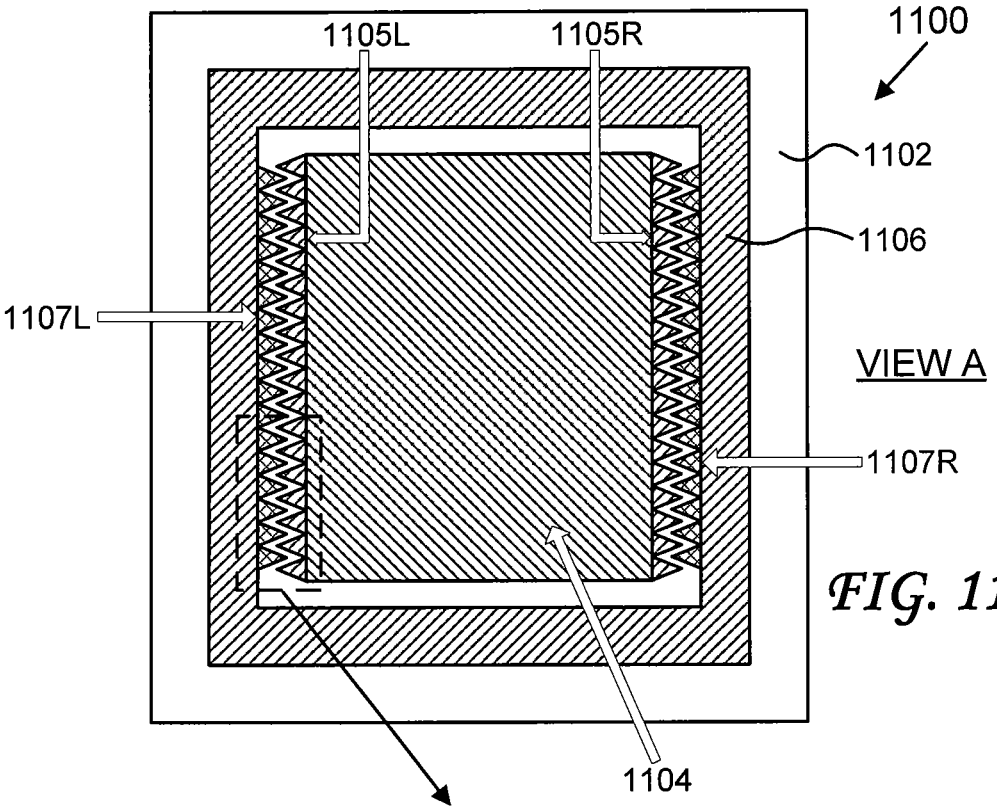
FIG. 11A and FIG. 11B show a dual-band patch antenna according to a tenth embodiment.

FIG. 11A (plan view, View A) shows a dual-frequency patch antenna 1100, according to a tenth embodiment. The dual-frequency patch antenna 1100 includes a conducting ground plane 1102, an inside radiator 1104, and an outside radiator 1106. The ground plane 1102, the inside radiator 1104, and the outside radiator 1106 each have a rectangular shape, which can be a square shape. The configuration is similar to that shown above in FIG. 10A, except protrusions are arrayed along only two opposite sides of the periphery of the inside radiator 1104 and along only two opposite sides of the inner periphery of the outside radiator 1106. The two opposite sides of the periphery of the inside radiator 1104 are referenced as side 1105L and side 1105R; the two opposite sides of the inner periphery of the outside radiator 1106 are referenced as side 1107L and side 1107R.

Figure 11B:
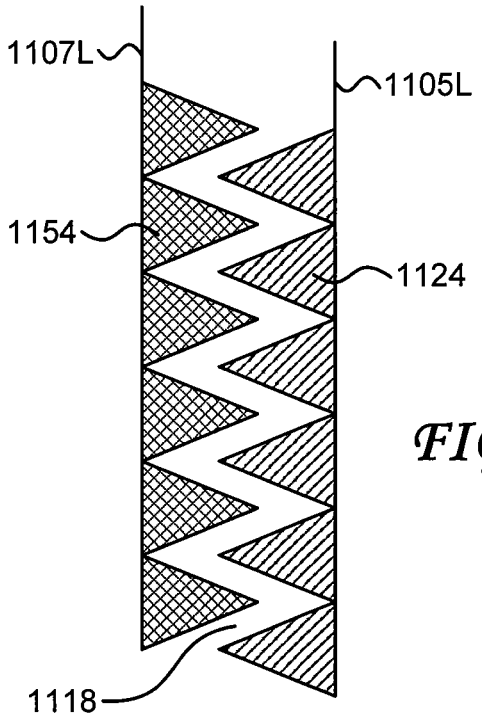

Details of these protrusions are shown in the magnified view of FIG. 11B. The series of protrusions 1124 extends along the side 1105L; the series of protrusions 1154 extends along the side 1107L. Similar series of protrusions extend along the side 1105R and the side 1107R, respectively (FIG. 11A). In this embodiment, a protrusion is characterized as a triangle. The two series of triangles are interdigitated such that a portion of a triangle in the series of protrusions 1124 is disposed within a 'V' between two adjacent triangles in the series of protrusions 1154 and a portion of a triangle in the series of protrusions 1154 is disposed within a 'V' between two adjacent triangles in the series of protrusions 1124. The series of protrusions 1124 and the series of protrusions 1154 are separated by the gap 1118. The series of protrusions 1124 and the series of protrusions 1154 can have other geometries; for example, a linear array of protrusions and grooves similar to those shown in FIG. 2A.

In FIG. 11A, both the inside radiator 1104 and the outside radiator 1106 are disposed on the same surface of a dielectric substrate (not shown); the configuration is similar to that shown in FIG. 2B. In other embodiments, the inside radiator 1104 and the outside radiator 1106 are disposed on opposite surfaces of a dielectric substrate, similar to the configurations shown in FIG. 3A, FIG. 4A, FIG. 5A, FIG. 6A, FIG. 7A, FIG. 8A, and FIG. 9A.

Figure 12A:
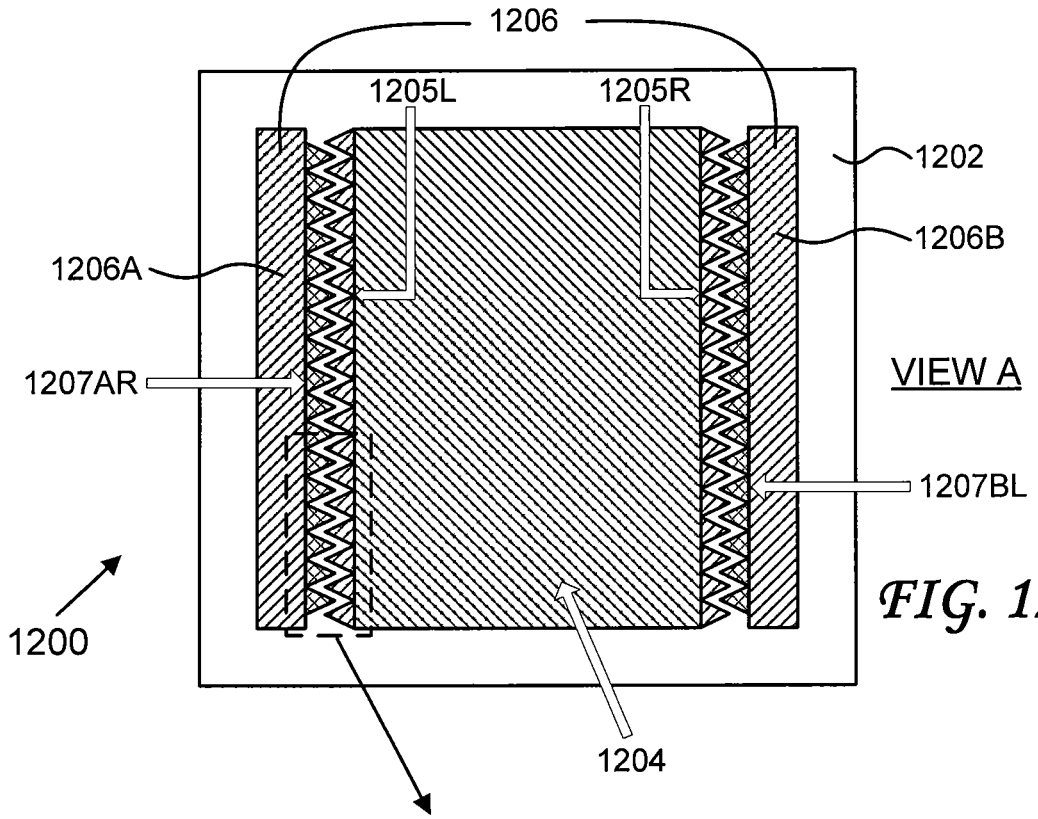
FIG. 12A and FIG. 12B show a dual-band patch antenna according to a ninth embodiment.

FIG. 12A (plan view, View A) shows a dual-frequency patch antenna 1200, according to an eleventh embodiment. The dual-frequency patch antenna 1200 includes a conducting ground plane 1202, an inside radiator 1204, and an outside radiator 1206. In this embodiment, the outside radiator 1206 is not configured as a ring: it is formed from two segments, referenced as the outside radiator segment 1206A and the outside radiator segment 1206B. The ground plane 1202, the inside radiator 1204, the outside radiator segment 1206A, and the outside radiator segment 1206B each have a rectangular shape, which can be a square shape. The outside radiator segment 1206A and the outside radiator segment 1206B are each fed by an individual exciting pin; the two individual exciting pins are 180 deg out of phase.

Figure 12B:
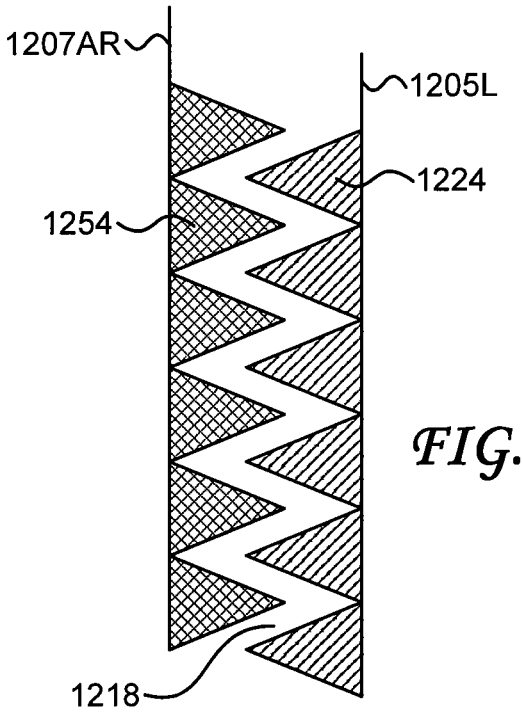

Details of the protrusions are shown in the magnified view of FIG. 12B. The series of protrusions 1224 extends along the side 1205L of the periphery of the inside radiator 1204; the series of protrusions 1254 extend along the side 1207AR of the inner periphery of the outside radiator segment 1206A. Similar series of protrusions extend along the side 1205R and the side 1207BL, respectively (FIG. 12A). In this embodiment, a protrusion is characterized as a triangle. The two series of triangles are interdigitated such that a portion of a triangle in the series of protrusions 1224 is disposed within a 'V' between two adjacent triangles in the series of protrusions 1254 and a portion of a triangle in the series of protrusions 1254 is disposed within a 'V' between two adjacent triangles in the series of protrusions 1224. The series of protrusions 1224 and the series of protrusions 1254 are separated by the gap 1218. The series of protrusions 1224 and the series of protrusions 1254 can have other geometries; for example, a linear array of protrusions and grooves similar to those shown in FIG. 2A.

In FIG. 12A, both the inside radiator 1204 and the outside radiator 1206 are disposed on the same surface of a dielectric substrate (not shown); the configuration is similar to that shown in FIG. 2B. In other embodiments, the inside radiator 1204 and the outside radiator 1206 are disposed on opposite surfaces of a dielectric substrate, similar to the configurations shown in FIG. 3A, FIG. 4A, FIG. 5A, FIG. 6A, FIG. 7A, FIG. 8A, and FIG. 9A.

The embodiments described above (FIG. 2A-FIG. 2J, FIG. 3A-FIG. 3C, FIG. 4A and FIG. 4B, FIG. 5A and FIG. 5B, FIG. 6A-FIG. 6E, FIG. 7A-FIG. 7D, FIG. 8A and FIG. 8B, FIG. 9A-FIG. 9F, FIG. 10A and FIG. 10B, FIG. 11A and FIG. 11B, and FIG. 12A and FIG. 12B) have various advantages and disadvantages with respect to cost of manufacture, tuning for performance, and integration of electronic components.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A dual-frequency patch antenna comprising:

a ground plane;

a dielectric substrate having a first surface facing away from the ground plane and a second surface facing towards the ground plane, the first surface and the second surface sharing a common layer of the dielectric substrate;

a dielectric medium disposed between the ground plane and the second surface of the dielectric substrate;

a first radiator disposed on the first surface of the dielectric substrate, the first radiator and the ground plane forming a first resonance cavity, wherein the first radiator comprises:

a first region bounded by a first periphery; and a series of first protrusions separated by a series of first grooves, wherein the series of first protrusions separated by the series of first grooves is disposed along the first periphery;

a second radiator disposed on the first surface of the dielectric substrate, the second radiator and the ground plane forming a second resonance cavity, wherein the second radiator comprises:

a second region bounded by a second periphery and a third periphery, wherein:

the second periphery is disposed within the third periphery; and the first periphery is disposed within the second periphery; and a series of second protrusions separated by a series of second grooves, wherein:

the series of second protrusions separated by the series of second grooves is disposed along the second periphery;

each first protrusion in the series of first protrusions is disposed partially within a corresponding second groove in the series of second grooves;

each first protrusion in the series of first protrusions does not contact any second protrusion in the series of second protrusions and does not contact the second periphery;

each second protrusion in the series of second protrusions is disposed partially within a corresponding first groove in the series of first grooves; and each second protrusion in the series of second protrusions does not contact the first periphery; and a set of conducting elements, wherein:

each conducting element in the set of conducting elements has a first end and a second end; and for each conducting element in the set of conducting elements:

the first end is electrically connected to a location selected from the group consisting of:

a location within a corresponding second protrusion in the series of second protrusions; and a location within the second region adjacent to a corresponding second protrusion in the series of second protrusions; and the second end is electrically connected to the ground plane.

2. The dual-frequency patch antenna of claim 1, wherein the dielectric medium is a dielectric solid or air.

3. The dual-frequency patch antenna of claim 1, wherein the first periphery is a first circle, the second periphery is a second circle, and the third periphery is a third circle.

4. The dual-frequency patch antenna of claim 1, further comprising:

a set of capacitive elements disposed along the third periphery.

5. The dual-frequency patch antenna of claim 1, further comprising:

a set of capacitive elements disposed on the ground plane along a path such that:

the path and the third periphery are geometrically similar; and a projection, onto the ground plane, of the third periphery is disposed on or within the path.

6. The dual-frequency patch antenna of claim 1, further comprising:

a set of first capacitive elements disposed along the third periphery; and a set of second capacitive elements disposed on the ground plane along a path such that:

the path and the third periphery are geometrically similar; and a projection, onto the ground plane, of the third periphery is disposed on or within the path.

7. The dual-frequency patch antenna of claim 1, further comprising an excitation system configured to excite:

circularly-polarized electromagnetic radiation in the first radiator; or linearly-polarized electromagnetic radiation in the first radiator.

8. The dual-frequency patch antenna of claim 1, further comprising an excitation system configured to excite:

circularly-polarized electromagnetic radiation in the second radiator; or linearly-polarized electromagnetic radiation in the second radiator.

9. The dual-frequency patch antenna of claim 1, further comprising:

a first excitation system configured to excite first circularly-polarized electromagnetic radiation in the first radiator; and a second excitation system configured to excite second circularly-polarized electromagnetic radiation in the second radiator.

10. A dual-frequency patch antenna comprising:

a ground plane;

a dielectric substrate having a first surface facing away from the ground plane and a second surface facing towards the ground plane, the first surface and the second surface sharing a common layer of the dielectric substrate;

a first radiator disposed on the first surface of the dielectric substrate, wherein the first radiator comprises:

a first region bounded by a first periphery; and a series of first protrusions separated by a series of first grooves, wherein the series of first protrusions separated by the series of first grooves is disposed along the first periphery;

a second radiator disposed on the second surface of the dielectric substrate, wherein the second radiator comprises:

a second region bounded by a second periphery and a third periphery, wherein the second periphery is disposed within the third periphery; and a series of second protrusions separated by a series of second grooves, wherein the series of second protrusions separated by the series of second grooves is disposed along the second periphery;

wherein the first radiator is disposed with respect to the second radiator such that:

a projection, onto the second surface, of the first periphery is disposed within the second periphery;

for each first protrusion in the first series of protrusions:

a projection, onto the second surface, of the first protrusion is disposed partially within a corresponding second groove in the series of second grooves;

for each second protrusion in the second series of protrusions:

the second protrusion is disposed partially within a projection, onto the second surface, of a corresponding first groove in the series of first grooves;

a dielectric medium disposed between the ground plane and the second surface of the dielectric substrate and between the ground plane and the second radiator; and a set of conducting elements, wherein:

each conducting element in the set of conducting elements has a first end and a second end; and for each conducting element in the set of conducting elements:

the first end is electrically connected to a location selected from the group consisting of:

a location within a corresponding second protrusion in the series of second protrusions; and a location within the second region adjacent to a corresponding second protrusion in the series of second protrusions; and the second end is electrically connected to the ground plane.

11. The dual-frequency patch antenna of claim 10, wherein, for each first protrusion in the series of first protrusions:

a projection, onto the second surface, of the first protrusion is further disposed partially within the second region.

12. The dual-frequency patch antenna of claim 10, wherein the dielectric medium is a dielectric solid or air.

13. The dual-frequency patch antenna of claim 10, wherein the first periphery is a first circle, the second periphery is a second circle, and the third periphery is a third circle.

14. The dual-frequency patch antenna of claim 10, further comprising:

a set of capacitive elements disposed along the third periphery.

15. The dual-frequency patch antenna of claim 10, further comprising:

a set of capacitive elements disposed on the ground plane along a path such that:

the path and the third periphery are geometrically similar; and a projection, onto the ground plane, of the third periphery is disposed on or within the path.

16. The dual-frequency patch antenna of claim 10, further comprising:

a set of first capacitive elements disposed along the third periphery; and a set of second capacitive elements disposed on the ground plane along a path such that:

the path and the third periphery are geometrically similar; and a projection, onto the ground plane, of the third periphery is disposed on or within the path.

17. The dual-frequency patch antenna of claim 10, further comprising an excitation system configured to excite:

circularly-polarized electromagnetic radiation in the first radiator; or linearly-polarized electromagnetic radiation in the first radiator.

18. The dual-frequency patch antenna of claim 10, further comprising an excitation system configured to excite:

circularly-polarized electromagnetic radiation in the second radiator; or linearly-polarized electromagnetic radiation in the second radiator.

19. The dual-frequency patch antenna of claim 10, further comprising:

a first excitation system configured to excite first circularly-polarized electromagnetic radiation in the first radiator; and a second excitation system configured to excite second circularly-polarized electromagnetic radiation in the second radiator.

20. A dual-frequency patch antenna comprising:

a ground plane;

a dielectric substrate having a first surface facing away from the ground plane and a second surface facing towards the ground plane, the first surface and the second surface sharing a common layer of the dielectric substrate;

a first radiator disposed on the second surface of the dielectric substrate, wherein the first radiator comprises:

a first region bounded by a first periphery; and a series of first protrusions separated by a series of first grooves, wherein the series of first protrusions separated by the series of first grooves is disposed along the first periphery;

a second radiator disposed on the first surface of the dielectric substrate, wherein the second radiator comprises:

a second region bounded by a second periphery and a third periphery, wherein the second periphery is disposed within the third periphery; and a series of second protrusions separated by a series of second grooves, wherein the series of second protrusions separated by the series of second grooves is disposed along the second periphery;

wherein the first radiator is disposed with respect to the second radiator such that:

a projection, onto the first surface, of the first periphery is disposed within the second periphery;

for each first protrusion in the series of first protrusions:

a projection, onto the first surface, of the first protrusion is disposed partially within a corresponding second groove in the series of second grooves; and for each second protrusion in the series of second protrusions:

the second protrusion is disposed partially within a projection, onto the first surface, of a corresponding first groove in the series of first grooves;

a dielectric medium disposed between the ground plane and the second surface of the dielectric substrate and between the ground plane and the first radiator; and a set of conducting elements, wherein:

each conducting element in the set of conducting elements has a first end and a second end; and for each conducting element in the set of conducting elements:

the first end is electrically connected to a location selected from the group consisting of:

a location within a corresponding second protrusion in the series of second protrusions; and a location within the second region adjacent to a corresponding second protrusion in the series of second protrusions; and the second end is electrically connected to the ground plane.

21. The dual-frequency patch antenna of claim 20, wherein, for each first protrusion in the series of first protrusions:

a projection, onto the first surface, of the first protrusion is further disposed partially within the second region.

22. The dual-frequency patch antenna of claim 20, wherein the dielectric medium is a dielectric solid or air.

23. The dual-frequency patch antenna of claim 20, wherein the first periphery is a first circle, the second periphery is a second circle, and the third periphery is a third circle.

24. The dual-frequency patch antenna of claim 20, further comprising:

a set of capacitive elements disposed along the third periphery.

25. The dual-frequency patch antenna of claim 20, further comprising:

a set of capacitive elements disposed on the ground plane along a path such that:

the path and the third periphery are geometrically similar; and a projection, onto the ground plane, of the third periphery is disposed within the path.

26. The dual-frequency patch antenna of claim 20, further comprising:

a set of first capacitive elements disposed along the third periphery; and a set of second capacitive elements disposed on the ground plane along a path such that:

the path and the third periphery are geometrically similar; and a projection, onto the ground plane, of the third periphery is disposed within the path.

27. The dual-frequency patch antenna of claim 20, further comprising an excitation system configured to excite:

circularly-polarized electromagnetic radiation in the first radiator; or linearly-polarized electromagnetic radiation in the first radiator.

28. The dual-frequency patch antenna of claim 20, further comprising an excitation system configured to excite:

circularly-polarized electromagnetic radiation in the second radiator; or linearly-polarized electromagnetic radiation in the second radiator.

29. The dual-frequency patch antenna of claim 20, further comprising:

a first excitation system configured to excite first circularly-polarized electromagnetic radiation in the first radiator; and a second excitation system configured to excite second circularly-polarized electromagnetic radiation in the second radiator.

30. A dual-frequency patch antenna comprising:

a ground plane;

a dielectric substrate having a first surface facing away from the ground plane and a second surface facing towards the ground plane, the first surface and the second surface sharing a common layer of the dielectric substrate;

a first radiator and the ground plane forming a first resonance cavity, the first radiator comprising:

a first region bounded by a first periphery, wherein the first region is disposed on the second surface;

a series of first protrusions separated by a series of first grooves, wherein:

the series of first protrusions separated by the series of first grooves is disposed on the first surface; and the series of first protrusions separated by the series of first grooves is disposed along a projection, onto the first surface, of the first periphery; and a set of first conducting elements, wherein each first conducting element in the set of first conducting elements has a first end and a second end; and for each first conducting element in the set of first conducting elements:

the first end is electrically connected to a location within a corresponding first protrusion in the series of first protrusions; and the second end is electrically connected along the first periphery;

a second radiator disposed on the second surface of the dielectric substrate, the second radiator and the ground plane forming a second resonance cavity and wherein the second radiator comprises:

a second region bounded by a second periphery and a third periphery, wherein the second periphery is disposed within the third periphery; and a series of second protrusions separated by a series of second grooves, wherein the series of second protrusions separated by the series of second grooves is disposed along the second periphery;

wherein the first radiator is disposed with respect to the second radiator such that:

the first periphery is disposed within the second periphery;

for each first protrusion in the series of first protrusions:

a projection, onto the second surface, of the first protrusion is disposed partially within a corresponding second groove in the series of second grooves; and for each second protrusion in the series of second protrusions:

the second protrusion is disposed partially within a projection, onto the second surface, of a corresponding first groove in the series of first grooves;

a dielectric medium disposed between the ground plane and the second surface of the dielectric substrate, between the ground plane and the first region, and between the ground plane and the second radiator; and a set of second conducting elements, wherein:

each second conducting element in the set of second conducting elements has a first end and a second end; and for each second conducting element in the set of second conducting elements:

the first end is electrically connected to a location selected from the group consisting of:

a location within a corresponding second protrusion in the series of second protrusions; and a location within the second region adjacent to a corresponding second protrusion in the series of second protrusions; and the second end is electrically connected to the ground plane.

31. The dual-frequency patch antenna of claim 30, wherein, for each first protrusion in the series of first protrusions:

a projection, onto the second surface, of the first protrusion is further disposed partially within the second region.

32. The dual-frequency patch antenna of claim 30, wherein the dielectric medium is a dielectric solid or air.

33. The dual-frequency patch antenna of claim 30, wherein the first periphery is a first circle, the second periphery is a second circle, and the third periphery is a third circle.

34. The dual-frequency patch antenna of claim 30, further comprising:

a set of capacitive elements disposed along the third periphery.

35. The dual-frequency patch antenna of claim 30, further comprising:

a set of capacitive elements disposed on the ground plane along a path such that:

the path and the third periphery are geometrically similar; and a projection, onto the ground plane, of the third periphery is disposed within the path.

36. The dual-frequency patch antenna of claim 30, further comprising:

a set of first capacitive elements disposed along the third periphery; and a set of second capacitive elements disposed on the ground plane along a path such that:

the path and the third periphery are geometrically similar; and a projection, onto the ground plane, of the third periphery is disposed within the path.

37. The dual-frequency patch antenna of claim 30, further comprising:

a set of contact pads disposed on the first surface along a path such that:

the path is geometrically similar to the third periphery;

a projection, onto the second surface, of the path is disposed within the third periphery; and each contact pad in the set of contact pads is dielectrically isolated from each first protrusion in the series of first protrusions; and a set of third conducting elements, wherein each third conducting element in the set of third conducting elements has a first end and a second end;

each third conducting element in the set of third conducting elements is dielectrically isolated from the second radiator; and for each third conducting element in the set of third conducting elements:

the first end is electrically connected to a corresponding contact pad in the set of contact pads;

the third conducting element passes through a corresponding hole in the second region; and the second end is electrically connected to the ground plane.

38. The dual-frequency patch antenna of claim 30, further comprising an excitation system configured to excite:

circularly-polarized electromagnetic radiation in the first radiator; or linearly-polarized electromagnetic radiation in the first radiator.

39. The dual-frequency patch antenna of claim 30, further comprising an excitation system configured to excite:

circularly-polarized electromagnetic radiation in the second radiator; or linearly-polarized electromagnetic radiation in the second radiator.

40. The dual-frequency patch antenna of claim 30, further comprising:

a first excitation system configured to excite first circularly-polarized electromagnetic radiation in the first radiator; and a second excitation system configured to excite second circularly-polarized electromagnetic radiation in the second radiator.

* * * * *